US008912968B2

(12) United States Patent
Sharma et al.

(10) Patent No.: US 8,912,968 B2
(45) Date of Patent: Dec. 16, 2014

(54) TRUE OMNI-DIRECTIONAL ANTENNA

(75) Inventors: Arun Kumar Sharma, Cupertino, CA (US); Robert J. Hill, Prunedale, CA (US); David Arthur Candee, Milpitas, CA (US)

(73) Assignee: SecureALL CORPORATION, Mountain View, CA (US)

( * ) Notice: Subject to any disclaimer, the term of this patent is extended or adjusted under 35 U.S.C. 154(b) by 262 days.

(21) Appl. No.: 13/340,520

(22) Filed: Dec. 29, 2011

(65) Prior Publication Data

US 2012/0169543 A1 Jul. 5, 2012

Related U.S. Application Data

(60) Provisional application No. 61/428,155, filed on Dec. 29, 2010.

(51) Int. Cl.
*H01Q 13/10* (2006.01)
*H01Q 9/04* (2006.01)
*H01Q 13/08* (2006.01)

(52) U.S. Cl.
CPC ..... *H01Q 13/085* (2013.01); *H01Q 9/0421* (2013.01)
USPC ..... 343/767; 343/700 MS

(58) Field of Classification Search
CPC ..... H01Q 13/085; H01Q 9/0421
USPC ..... 343/700 MS, 767, 770
See application file for complete search history.

(56) References Cited

U.S. PATENT DOCUMENTS

| | | | | |
|---|---|---|---|---|
| 4,200,871 | A | 4/1980 | Roeder et al. | |
| 4,853,704 | A * | 8/1989 | Diaz et al. | 343/767 |
| 4,855,749 | A | 8/1989 | DeFonzo | |
| 4,978,965 | A * | 12/1990 | Mohuchy | 343/727 |
| 5,036,335 | A | 7/1991 | Jairam | |
| 5,187,489 | A * | 2/1993 | Whelan et al. | 343/767 |
| 5,519,408 | A | 5/1996 | Schnetzer | |
| 5,557,291 | A * | 9/1996 | Chu et al. | 343/725 |
| 6,020,733 | A | 2/2000 | Bradley | |
| 6,043,785 | A | 3/2000 | Marino | |
| 6,337,628 | B2 | 1/2002 | Campana, Jr. | |
| 6,876,334 | B2 * | 4/2005 | Song et al. | 343/767 |
| 7,019,617 | B2 | 3/2006 | Pratt et al. | |

(Continued)

OTHER PUBLICATIONS

PCT International Search Report and Written Opinion mailed Feb. 19, 2010, Application No. PCT/US2009/050180, 16 pages.

(Continued)

*Primary Examiner* — Tho G Phan
(74) *Attorney, Agent, or Firm* — Haynes and Boone, LLP

(57) ABSTRACT

An antenna and a method for using the antenna in a wireless appliance are provided. The antenna includes a conducting surface having a length and a width; a dielectric slit having a slit length portion oriented along either the length or the width, the slit forming two lips on the conducting surface; the slit having an opening on one of the length and the width, the opening having a flare size; a feed-point element connecting the two lips; wherein the dimensions of the length, the width, the slit length portion, and the flare size are smaller than an effective propagation wavelength of the RF radiation in the antenna. An antenna including a conducting surface having a conductive plate with a plate area defined by a plate perimeter overlaying a portion of a conducting surface is also provided. A method to provide an antenna as above is also disclosed.

24 Claims, 21 Drawing Sheets

(56) References Cited

U.S. PATENT DOCUMENTS

| | | | | |
|---|---|---|---|---|
| 7,106,246 | B1 | 9/2006 | Lindell | |
| 7,142,838 | B2 | 11/2006 | Rotzol | |
| 7,199,634 | B2 | 4/2007 | Cho et al. | |
| 7,652,632 | B2 | 1/2010 | Shtrom | |
| 7,804,458 | B2 * | 9/2010 | Montgomery et al. | 343/767 |
| 2003/0119568 | A1 | 6/2003 | Menard | |
| 2003/0142737 | A1 | 7/2003 | Tarng | |
| 2003/0214450 | A1 | 11/2003 | Lynch et al. | |
| 2004/0192222 | A1 | 9/2004 | Vaisanen et al. | |
| 2004/0259544 | A1 | 12/2004 | Amos | |
| 2005/0063348 | A1 | 3/2005 | Donovan | |
| 2006/0030373 | A1 | 2/2006 | Park | |
| 2006/0100000 | A1 | 5/2006 | Marples et al. | |
| 2006/0154708 | A1 | 7/2006 | Bogner | |
| 2006/0222118 | A1 | 10/2006 | Murthy et al. | |
| 2007/0103367 | A1 | 5/2007 | Wang | |
| 2007/0111746 | A1 | 5/2007 | Anderson | |
| 2007/0149257 | A1 | 6/2007 | Cheresh | |
| 2007/0183449 | A1 | 8/2007 | Beagley et al. | |
| 2008/0084836 | A1 | 4/2008 | Baird et al. | |
| 2008/0088514 | A1 | 4/2008 | Su et al. | |
| 2008/0231522 | A1 | 9/2008 | Montgomery et al. | |
| 2008/0316128 | A1 | 12/2008 | Apostolos | |
| 2009/0262036 | A1 | 10/2009 | Thevenard et al. | |
| 2009/0303131 | A1 | 12/2009 | Schano | |
| 2010/0040120 | A1 | 2/2010 | Sharma | |

OTHER PUBLICATIONS

Long, John "SiGe Radio Frequency ICs for Low-Power Portable Communication,," Proceedings of the IEEE, vol. 93, No. 9, Sep. 2005, 26 pages.

PCT International Search Report and Written Opinion mailed Feb. 19, 2010, Application No. PCT/US2011/067981, 10 pages.

* cited by examiner

TRUE OMNI-DIRECTIONAL ANTENNA

CROSS-REFERENCE TO RELATED APPLICATIONS

The present application is related and claims priority to U.S. Provisional Patent Application No. 61/428,155, entitled "True Omni-directional Antenna," by Arun Kumar Sharma, David Arthur Candee, and Robert Hill filed on, Dec. 29, 2010, the contents of which are hereby incorporated by reference in their entirety, for all purposes.

BACKGROUND

1. Field of the Invention

Embodiments described herein relate to the field of wireless communication devices and systems. More particularly, embodiments described herein relate to the field of omni-directional antennas for emitters and receivers in wireless communication systems.

GLOSSARY $D_k$: Dielectric Constant

PCB: Printed Circuit Board $\lambda$ or $\lambda_0$: Free space wavelength, for practical purposes same as wavelength in air.

$\lambda_{Dk}$: Wavelength in a material with Dk dielectric constant. Including end fringing effect.

$\lambda_e$: Wavelength in an environment that has a dielectric layer whose thickness is much smaller than $\lambda_{Dk}$ (typically $<\frac{1}{4}\lambda_{Dk}$), thus includes effect of environment's Dk. Including end fringing effect.

LoS: Line of Sight

Link Budget:

For a line-of-sight radio system, a link budget equation might look like this:

$$P_{RX}=P_{TX}+G_{TX}-L_{TX}-L_{FS}-L_M+G_{RX}-L_{RX}$$

where:

$P_{RX}$=received power (dBm)

$P_{TX}$=transmitter output power (dBm)

$G_{TX}$=transmitter antenna gain (dBi)

$L_{TX}$=transmitter losses (coax, connectors . . . ) (dB)

$L_{FS}$=free-space loss or path loss (dB)

$L_{LM}$=miscellaneous losses (fading margin, body loss, polarization mismatch, other losses . . . ) (dB)

$G_{RX}$=receiver antenna gain (dBi)

$L_{RX}$=receiver losses (coax, connectors . . . ) (dB)

Signal quality measurement: Signal measurements including but not limited to RSSI (Received signal strength indicator), LQI (Line quality indicator), BER (bit error rate) etc.

CAD: Computer Aided Design tool

VNA: Vector Network Analyzer equipment used to measure RF impedance and also two port transfer characteristic.

2. Description of Related Art

In the context of the present disclosure, a wireless appliance is understood as a device having a wireless communication capability. The device may be mobile or fixed to a station. In the field of wireless communications, wireless appliances are used to receive and transmit a signal to and from another wireless appliance. Either of a transmitter and a receiver may be moving, or in a fixed position. In order to receive and transmit radio-frequency (RF) signals, wireless appliances use antennas to couple freely propagating RF radiation and electrical signals in circuitry coupled to the antenna.

Typically, antennas are designed to have directional radiation patterns to preferentially emit or receive radiation into or from a desired direction. In many cases a design adapts a package to the antenna's limitation, adapting a device to radiate in a preferred direction. Most antennas exhibit different radiation patterns when coupled to vertical polarization and horizontal polarization, where a vertical and a horizontal direction are defined with respect to an antenna plane.

The RF propagation loss for line-of-sight (LoS) wireless communication between a transmitter and a receiver is a function of:

a. A distance between transmitter and receiver.

b. A transmitter's antenna gain in the direction of the receiver, relative to the orientation of the transmitter.

c. A receivers antenna gain in the direction of the transmitter, relative to the orientation of the receiver.

d. An operating frequency.

Due to b. above, it is difficult to estimate the distance between an arbitrarily oriented mobile wireless appliance and a fixed receiver using conventional antennas. Some strategies for estimating a transmitter-receiver distance use receiver signal strength indicator (RSSI) in their algorithms, or other 'signal quality measurement' parameters. Use of RSSI based algorithms is hampered by the high directional sensitivity of signal strength in state-of-the-art wireless systems and antennas. A person may carry a mobile wireless appliance in a varying orientation. Thus, the antenna gain of the mobile wireless appliance with respect to a fixed receiver will be unpredictable and highly variable. Typical antennas have radiation patterns with deep minima, and usually showing a high maxima-to-minima ratio. The difference between the peak antenna gain and the minimum antenna gain for various antenna orientations is generally more than 20 dB, and often as high as 50 dB. Thus, in state-of-the-art wireless communications the signal strength not only depends on the distance between the transmitter and the receiver, but also is highly dependent on relative antenna orientation.

In order to account for the aforementioned (maxima-to-minima) variance in antenna gain, low power mobile wireless appliances are often designed with far greater (pessimistic) link-budget compared to equivalent fixed wireless appliances communicating across the same distance. This adds complexity and expense to a wireless system with mobile wireless appliances, not to mention that it requires designing greater maximum transmitter power. High power usage is inconvenient due to frequently recharging or changing batteries. The additional expense is due to increased peak transmitter power, increased receiver sensitivity, increased battery capacity, increased size, increased material cost, and increased electromagnetic interference (EMI) effects.

Tapered slot antennas have been used extensively as linear polarized radiators. Linearly tapered slot antennas or exponentially tapered slot antennas, commonly known as notch antennas or Vivaldi antennas have been used. Terms like "tapered-notch," "flared-slot," and "tapered-slot" antennas have been used interchangeably with Vivaldi antennas in the literature. Linear slot antennas have been disclosed in U.S. Pat. No. 4,855,749 (DeFonzo); exponentially tapered slot antennas have been disclosed in U.S. Pat. No. 5,036,335 (Jairam), and U.S. Pat. No. 5,519,408 (Schnetzer). The conventional Vivaldi antenna is a directional antenna, having an end-fire radiation pattern with a high front-to-back gain ratio. Also, Vivaldi antennas are relatively large compared to the effective wavelength, $\lambda_e$, of the electromagnetic radiation that they are designed to detect. For example, some conventional Vivaldi antennas have a slot length that is many times $\lambda_e/4$.

Gain of exponentially tapered slot antennas with conventional designs and dimensions is not satisfactory in terms of directional gain uniformity.

Therefore, there is a need for antenna designs and systems in wireless communication providing high efficiency which is uniform and omni-directional.

SUMMARY

According to embodiments disclosed herein, an antenna for use in a wireless appliance may include a conducting surface having a length and a width; a dielectric slit having a slit length portion oriented along either the length or the width, the slit forming two lips on the conducting surface; the slit having an opening on one of the length and the width, the opening having a flare size; a feed-point element connecting the two lips; wherein the dimensions of the length, the width, the slit length portion, and the flare size are smaller than an effective propagation wavelength of the RF radiation in the antenna.

According to embodiments disclosed herein an antenna for use in a wireless appliance may include a conducting surface having a length and a width; a conductive plate having a plate area defined by a plate perimeter overlaying a portion of the conducting surface, the conductive plate having a contact portion and a feed point; a gap formed between the conductive surface and the conductive plate; a feed-point element connecting the conductive plate to the conductive surface; wherein a length dimension, a width dimension, a plate area dimension, the plate perimeter, and the gap are smaller than an effective propagation wavelength of the RF radiation.

According to embodiments disclosed herein an antenna for use in wireless appliances may include a conducting surface having a length and a width; a dielectric slit having a slit length portion oriented along either one of the length and the width, the slit forming two lips on the conducting surface; the slit having an opening on one of the length and the width, the opening having a flare size; a first feed-point element connecting the two lips; a conductive plate having a plate area defined by a plate perimeter overlaying a portion of the conducting surface, the conductive plate having a contact portion and a feed point; a gap formed between the conductive surface and the conductive plate; a second feed-point element connecting the conductive plate to the conductive surface; wherein a length dimension, a width dimension, the slit length portion, the flare size, a plate area dimension, the plate perimeter, and the gap are smaller than an effective propagation wavelength of the RF radiation.

According to embodiments disclosed herein, a method for estimating a distance using a wireless signal may include providing a wireless signal from a first communication partner having a wireless appliance including an emitter device; receiving the wireless signal at a second communication partner having a wireless appliance including a receiver device; obtaining a signal quality of the received wireless signal; estimating a distance separating the first communication partner from the second communication partner; wherein the signal quality of the received wireless signal is independent of the relative orientation of the emitter device and the receiver device; and the signal quality of the received wireless signal is independent of the polarization of an RF radiation carrying the wireless signal.

According to embodiments disclosed herein a method to provide an antenna in a wireless appliance may include providing an antenna layout, the layout including a length dimension, a width dimension, a slit length portion dimension, a flare size, and a feed-through distance; obtaining an RF field coupling to the antenna layout; comparing the RF field coupling to the antenna layout to a quality standard; modifying the antenna layout when the RE field coupling to the antenna fails to satisfy the quality standard; wherein the length dimension, the width dimension, the slit length portion dimension, the flare size, and the feed through distance are smaller than an effective propagation wavelength of the RF field in the antenna.

These and other embodiments of the present invention will be described in further detail below with reference to the following drawings.

BRIEF DESCRIPTION OF THE DRAWINGS

In the figures, like elements are assigned like reference numbers.

DETAILED DESCRIPTION

Figure 1:
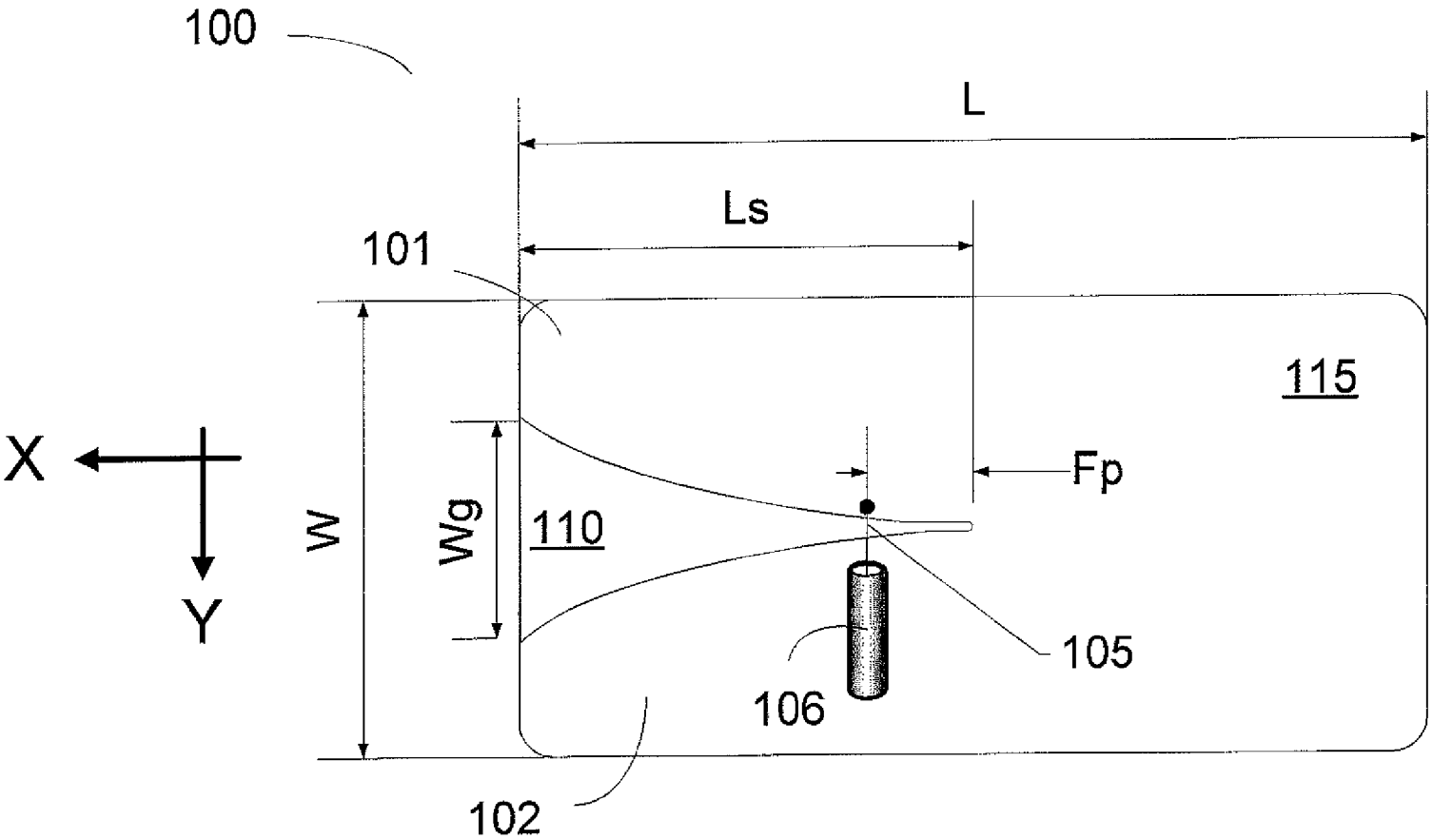
FIG. 1 illustrates a partial plan view of an omnidirectional antenna, according to embodiments disclosed herein.

Wireless appliances as disclosed herein may be a cell phone, Bluetooth headset or a palm device having internet connectivity. In some embodiments, a wireless appliance as disclosed herein may be a hands-free key carried by a user in order to have access to doors in buildings and vehicles. An omni-directional antenna according to embodiments disclosed herein has a lower link budget as compared to conventional antennas having a high directivity and high maxima-to-minima directional gain. This is because the inherent minimum directional gain is higher for an omni-directional antenna than for a conventional antenna, according to embodiments disclosed herein. Thus, embodiments consistent with the present disclosure have a simple design that reduces costs and possibly consumes less power. This results in a simpler, more compact, and more economic product with a longer battery life.

Embodiments disclosed herein include a portable antenna device with near omni-directional characteristics. In some configurations, an omni-directional antenna may be used to ensure effective range estimation based on signal quality, regardless of antenna orientation with respect to a partner RF communication device. In some embodiments one of the partners may be a wireless appliance including an RF communication device using a circularly polarized antenna or a pair of orthogonal linearly polarized antennas.

According to some embodiments, a Printed Circuit Board (PCB) area includes an omni-directional antenna and electronic circuit components mounted on the board. Such embodiments allow lower manufacturing costs and provide a compact design suitable for small RF appliances.

An omni-directional antenna that is compact, has an appropriate bandwidth, and has high efficiency is desirable for use in mobile wireless appliances. In some embodiments, an appropriate bandwidth is a frequency bandwidth tuned to a center frequency and allowing for about 3-20% bandwidth detuning from the center frequency with good efficiency.

The antenna bandwidth obtained in embodiments consistent with the present disclosure is broader than a classical dipole antenna. While a 3-20% of center frequency bandwidth allows for certain amount of detuning, this bandwidth is not as broad as the wideband characteristics of a classical Vivaldi antenna. Thus, some embodiments do not pick up interference from out-of-band broadcasting devices, as Vivaldi antennas do.

An omni-directional antenna according to embodiments disclosed herein may be less sensitive to detuning, which is desirable for mobile wireless appliances. Detuning in mobile wireless appliances may be caused by proximity to body tissue or other materials, as the wireless appliance is carried by a person in a pocket, briefcase, or bag.

The realization of robust communication with mobile wireless appliances in an environment that can cause antenna detuning is desirable for range estimation and related applications. In range estimation, RSSI based algorithms are used to find the distance between a transmitter and a receiver in a LoS configuration. Having an omni-directional antenna is highly desirable to avoid the need to estimate relative spatial orientation in mobile configurations.

Some embodiments disclosed herein have a layout that lends itself to implementing two (or more) antennas on a common PCB. The two or more antennas may be tuned to the same resonance frequency or to somewhat different resonance frequencies. Thus, some embodiments disclosed herein allow for multiband antenna operation in a single PCB circuit. Such embodiments may be desirable in wireless appliances using multiple antennas.

FIG. 1 illustrates a partial plan view of an omni-directional antenna 100, according to embodiments disclosed herein. Omni-directional antenna 100 includes a conductive layer 115 having a dielectric slit 110 cut out on one side. The dielectric slit 110 forms lips 101 and 102 in layer 115. Antenna feed-element 105 joins lip 101 to pickup antenna RF signal and couples it to a transmission line (coaxial cable) 106. In some embodiments consistent with the present disclosure, antenna 100 has a rectangular profile with length 'L' and width 'W'. In some embodiments, length L is greater than width W. Dielectric slit 110 has a depth 'Ls' along length L of antenna 100, and a flare width 'Wg' along width W. Antenna feed point 105 may be appropriately placed across slit 110 at a distance 'Fp' from the tip of slit 110 to match desired transmission line impedance.

According to some embodiments, the RF signal having a wavelength λ0 propagates freely through the environment and is coupled into omni-directional antenna 100 through lips 101 and 102. Wavelength λ0 is the free space wavelength of the RF signal. In some embodiments, λ0 is the wavelength of a desired RF signal in air. Conductive layer 115 is made of copper, according to some embodiments. Dielectric slit 110 is made of a material having a dielectric constant, Dk. According to some embodiments, Dk is greater than the dielectric constant of air at wavelength λ0. In some embodiments, conductive layer 115 may be embedded in a PCB having a substrate made of the material forming dielectric slit 110. According to some embodiments, feed-through 105 includes a galvanic connection to lips 101 and 102. In some embodiments, feed-point 105 is capacitively connected to lips 101 and 102, yet in some embodiments lips 101 and 102 may be connected by an open ended transmission line whose electrical length is quarter-wave or less. Antenna 100 may be formed on an insulating substrate including slit 110, and having a conductive surface forming layer 115.

An RF signal propagating through the environment at wavelength λ0 has a wavelength λDk when propagating in a material with dielectric constant Dk. Furthermore, when the RF signal having free space wavelength λ0 is coupled into a thin layer of material having dielectric constant Dk and a thickness much smaller than λDk, the signal propagates with an effective wavelength, λe. Wavelength λe is the wavelength of RF signals in a dielectric layer whose thickness is typically smaller than ¼λDk. Thus, λe includes boundary effects resulting from the shape and size of the dielectric layer, such as end-fringing effects.

In some embodiments, antenna 100 is implemented in a thin planar shape having length L approximately equal to ½λe, and width W approximately equal to ¼λe. In some embodiments width W is comparable to ¼λe, but not exactly equal to ¼λe. Further, some embodiments may have a slit length Ls approximately equal to ¼λe. The position of feed point, Fp, may vary according to a desired impedance matching to transmission line 106. In some embodiments, a 50 ohm match is found when Fp is approximately λe/15. According to embodiments consistent with the present disclosure, flare width Wg may be approximately equal to λe/8.

In some embodiments consistent with the present disclosure, a length 'L', width 'W', slit depth, 'Ls', flare width 'Wg', and distance 'Fp' may be selected for an RF wavelength λ0 corresponding to frequencies in a range between about 100 MHz (mega-Hertz, $10^6$ Hz) and about 20 GHz (Giga-Hertz, $10^9$ Hz). Thus, in some embodiments antenna dimensions as described above may range from about a meter or so (for 100 MHz applications), down to a few millimeters (for 20 GHz applications). One of regular skill in the art would realize that antenna dimensions scale with inverse of frequency.

A planar, Y shaped antenna such as antenna 100 having a feed point Fp between lips 101 and 102 responds with uniform sensitivity to radiation emanating from multiple directions. In some configurations where a freely propagating RF signal includes two orthogonal polarizations, lack of sensitivity of antenna 100 in one polarization is compensated by good sensitivity of antenna 100 in the orthogonal polarization. Thus, irrespective of its own orientation, antenna 100 communicates with uniform sensitivity with a wireless appliance that has two orthogonally linearly polarized antennas. This will be described in more detail with reference to FIGS. 2A and 2B, below.

Figure 2A:
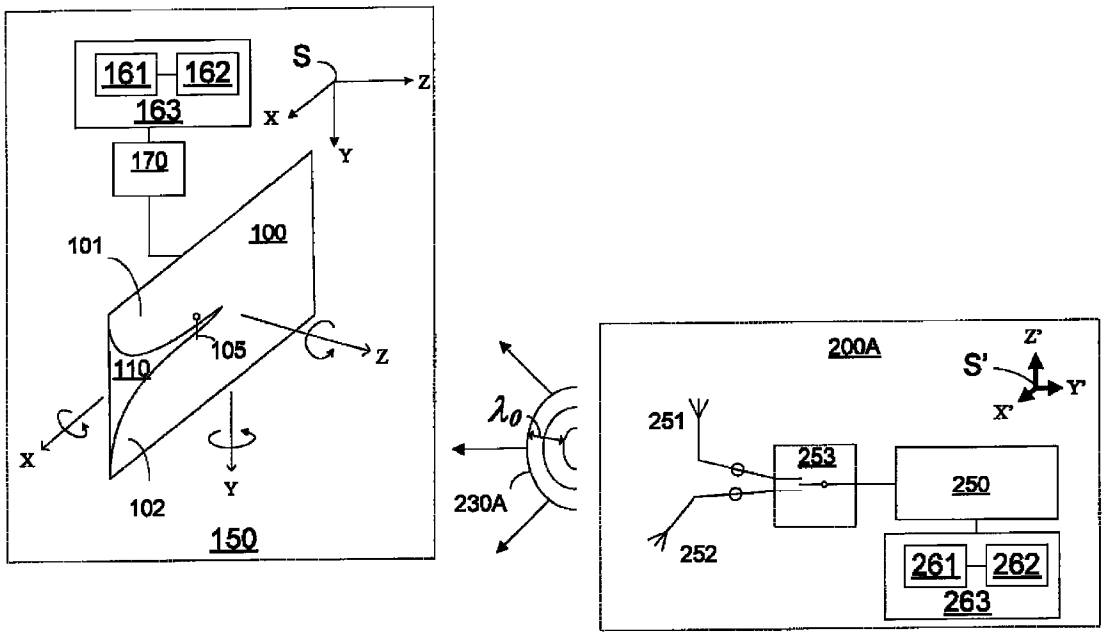
FIG. 2A illustrates an orientation-independent communication configuration between two wireless appliances, according to embodiments disclosed herein.
Figure 2B:
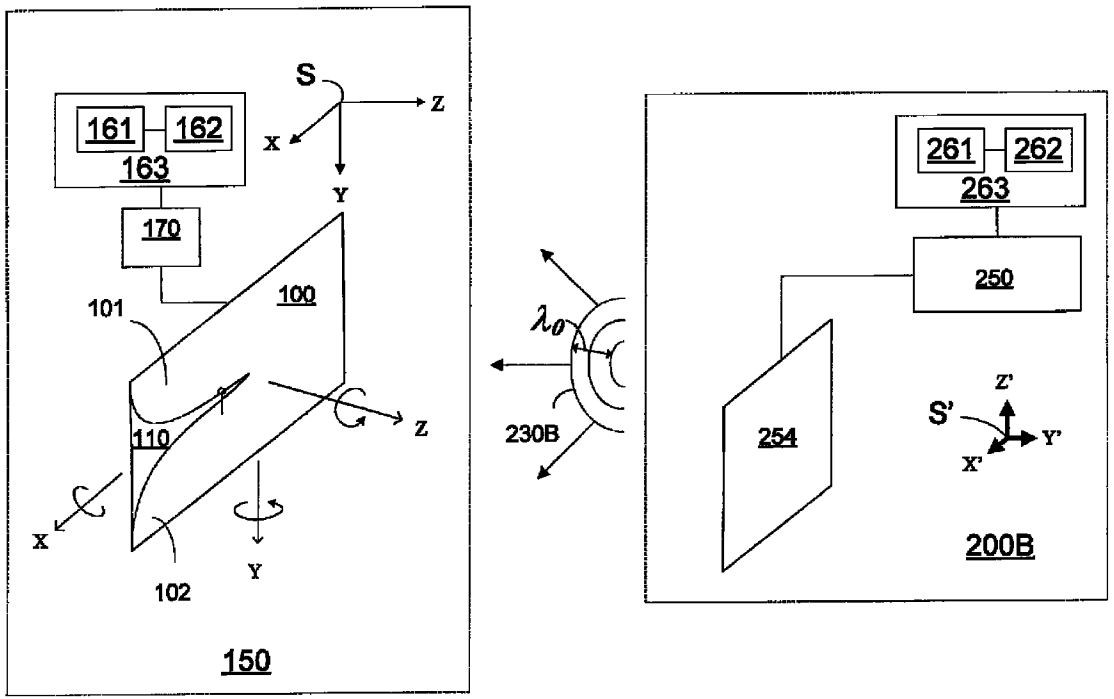
FIG. 2B illustrates an orientation-independent communication configuration between two wireless appliances, according to embodiments disclosed herein.

In embodiments consistent with the present disclosure, radio devices disclosed in FIGS. 2A and 2B may interchange emitter role and receiver role in a communication process. One of regular skill in the art would recognize that embodiments disclosed herein are not limiting as to whether an antenna is emitting RF radiation or receiving RF radiation. A radio device as disclosed herein may include a radio receiver and a radio transmitter, or a radio receiver, or a radio transmitter.

FIG. 2A illustrates an orientation-independent communication configuration between a wireless appliance 150 and a wireless appliance 200A, according to embodiments disclosed herein. Wireless appliance 150 includes a radio 160, a controller 163 having a processor chip 161 and a memory chip 162. Controller 163 may be a computer or an Application Specific Integrated Chip (ASIC) to control radio 170, which in turn uses the omni-directional antenna 100. Wireless appliance 200A includes a controller 263 having a processor chip 261 and a memory chip 262. In some embodiments, wireless appliance 200A includes two linear antennas 251 and 252 that are orthogonally oriented. Controller 263 controls a radio 250, according to some embodiments. Radio 250 is coupled to a switch 253 that can be controlled to connect the radio with either vertically polarized antenna 251 or horizontally polarized antenna 252.

In some embodiments appliances 200A and 150 can communicate with each other bi-directionally or uni-directionally. Communication in one direction requires a radio in one appliance to transmit while the radio in other appliance must receive, communication in other direction requires vice versa.

For the RF radiation emitted from or received by wireless appliance 200A the definition of 'vertical' and 'horizontal' is not limiting, in reference to an arbitrarily oriented, right-handed Cartesian frame S' (X', Y', Z'). Thus, the direction may be the 'vertical' orientation, and a 'horizontal' direction may be any direction in the X',Y' plane, such as the X' direction. While the selection of frame S' is arbitrary, it is understood hereinafter that frame S' remains fixed relative to wireless appliance 200A. In some embodiments, wireless appliance 200A may be a fixed transmitter station, receiver station, a transceiver station, or a mobile device.

According to some embodiments, the signal from radio emitter 250 may be simultaneously broadcasted by vertical antenna 251 and horizontal antenna 252. Thus, in some embodiments switch 253 operates as a signal splitter or a multiplexer rather than a switch. Wireless appliance 200A generates an RF signal 230A having a free space wavelength λ0. Note that dimensions in FIGS. 2A and 2B are not necessarily drawn up to scale. RF signal 230A travels freely through the environment and reaches antenna 100, which has an arbitrary orientation according to a right-handed Cartesian frame S (X,Y,Z), relative to wireless appliance 150. The specific choice of axes (X,Y,Z) and handedness in Cartesian system S is not limiting. Hereinafter, the Z-axis will be chosen as the axis perpendicular to the plane formed by the length L and the width W of antenna 100. The X-axis is shown as the axis along length L, and the Y-axis is shown as the axis along width W, of antenna 100.

FIG. 2B illustrates an orientation-independent communication configuration between wireless appliance 150 and wireless appliance 200B, according to embodiments disclosed herein. Wireless appliance 200B includes circularly polarized antenna 254 coupled to radio emitter 250. Thus, radiation 230B includes circularly polarized radiation, which may be envisioned as a vertically polarized signal and a horizontally polarized signal, phase-shifted by a quarter wavelength (¼λ0). In some embodiments, radio device 250 may be a receiver of a signal emitted by wireless appliance 150.

FIGS. 2A-2B illustrates an antenna design and communication system that allows an appliance to robustly communicate with another appliance even if the relative orientation of each appliance is subject to independent and uncontrollable change. The antenna utilizes a novel design that exhibits true omni-directional radiation when partnered with an appliance that uses a circularly polarized antenna, or a set of orthogonal linearly polarized antennas for radio communication. The antenna design can be made to exhibit wide bandwidth to make it robust in an environment that can induce antenna detuning.

For an LoS radio system, a link budget equation might include the following terms:

$$P_{RX}=P_{TX}+G_{TX}-L_{TX}-L_{FS}-L_M+G_{RX}-L_{RX} \quad (1)$$

where: $P_{RX}$ is the received power (dBm); $P_{TX}$ is the transmitter output power (dBm); $G_{TX}$ is the transmitter antenna gain (dBi); $L_{TX}$ represents transmitter losses (coaxial cables, connectors, and other elements) (dB); $L_{FS}$ is the free space loss or path loss (dB); $L_M$ are miscellaneous losses (fading margin, body loss, polarization mismatch, other losses) (dB); $G_{RX}$ is the receiver antenna gain (dBi); $L_{RX}$ represents receiver losses (coaxial cables, connectors, and other elements) (dB). $L_{FS}$ is determined by following terms:

$$L_{FS}=32.4\text{ dB}+20\times\log(f/1\text{ GHz})+10\times n\times\log(d/1\text{ meter}) \quad (2)$$

Whereby:

f—frequency (GHz), d—distance (m)

n=2 for LoS (Line of sight)

where $L_{FS}$ includes a $1/R^2$ loss term, with R an absolute distance between emitter and receiver.

When RF radiation 230A or 230B is received by antenna 100, an appliance including antenna 100 may perform a signal quality measurement. In some embodiments, a signal quality measurement may include RSSI, Line quality indicator (LQI), or bit error rate (BER), among others.

A signal quality measurement may be used to optimize the design and performance of omni-directional antenna 100, according to some embodiments. For example, a Computer Aided Design (CAD) tool may be used to simulate the propagation and coupling of RF signal 200A to antenna 100. In some embodiments, a prototype of antenna 100 may be tested using Vector Network Analyzer (VNA) equipment to measure RF impedance and also two-port transfer characteristic. Different variations of antenna parameters such as length L, width W, slit length Ls, flare width Wg, and feed-point distance Fp may be optimized according to embodiments described herein. Furthermore, a CAD tool and VNA equipment may be used to optimize the specific shape of slit 110 and lips 101 and 102, feed-point Fp as well as width of the side opposite to the slit in antenna 100.

An omni-directional antenna consistent with embodiments described herein can be used in flight termination systems for rockets and missiles. In addition, the design can be used for command, telemetry and tracking systems in flight vehicles (e.g. remotely piloted aircraft, robot or spacecraft) due to its omni-directional feature. This results in compact and versatile systems in the above applications.

Figure 3A:
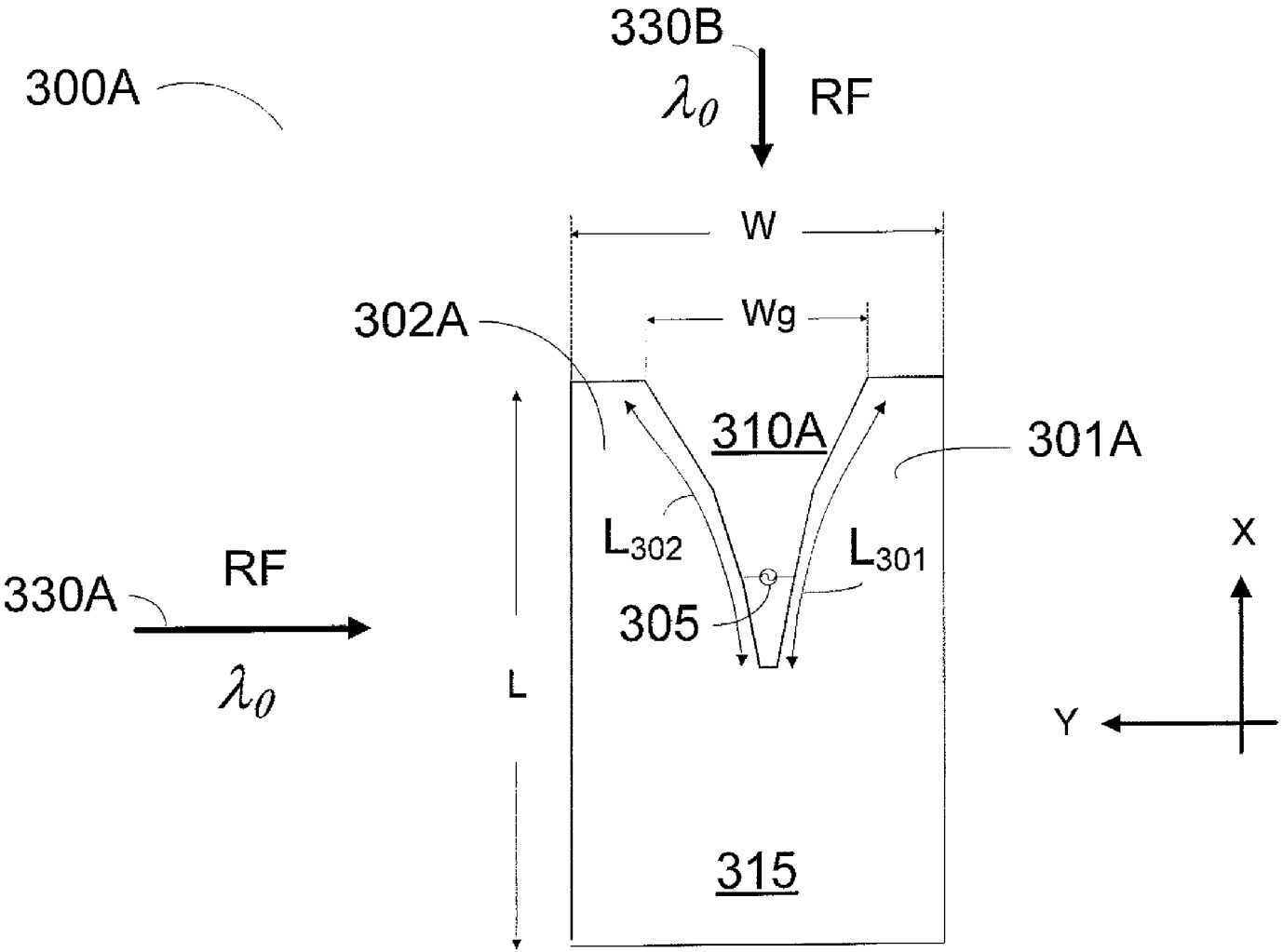
FIG. 3A illustrates a partial plan view of an omni-directional antenna, according to embodiments disclosed herein.

FIG. 3A illustrates an omni-directional antenna 300A, according to embodiments disclosed herein. Antenna 300A includes layer 315, slit 310A, lips 301 and 302, and feed-point 305. Layer 315 and feed-point 305 may be as described in detail above with respect to layer 115, slit 110, and feed-point 105 in antenna 100 (cf. FIG. 1). Slit 310 forming lips 301A and 302A may have a shape including sides L301 and L302. According to embodiments disclosed herein, the length of sides L301 and L302 may be approximately equal to ¼λe.

In some embodiments, the bandwidth of antenna 300A may be increased by making sides L301 and L302 of slightly different length relative to one another. This is similar to coupling two circuits that are tuned to slightly different frequencies. A wideband performance may be desirable to overcome antenna detuning effects introduced by proximity to human body or other objects having dielectric and/or conductive properties.

Figure 3B:
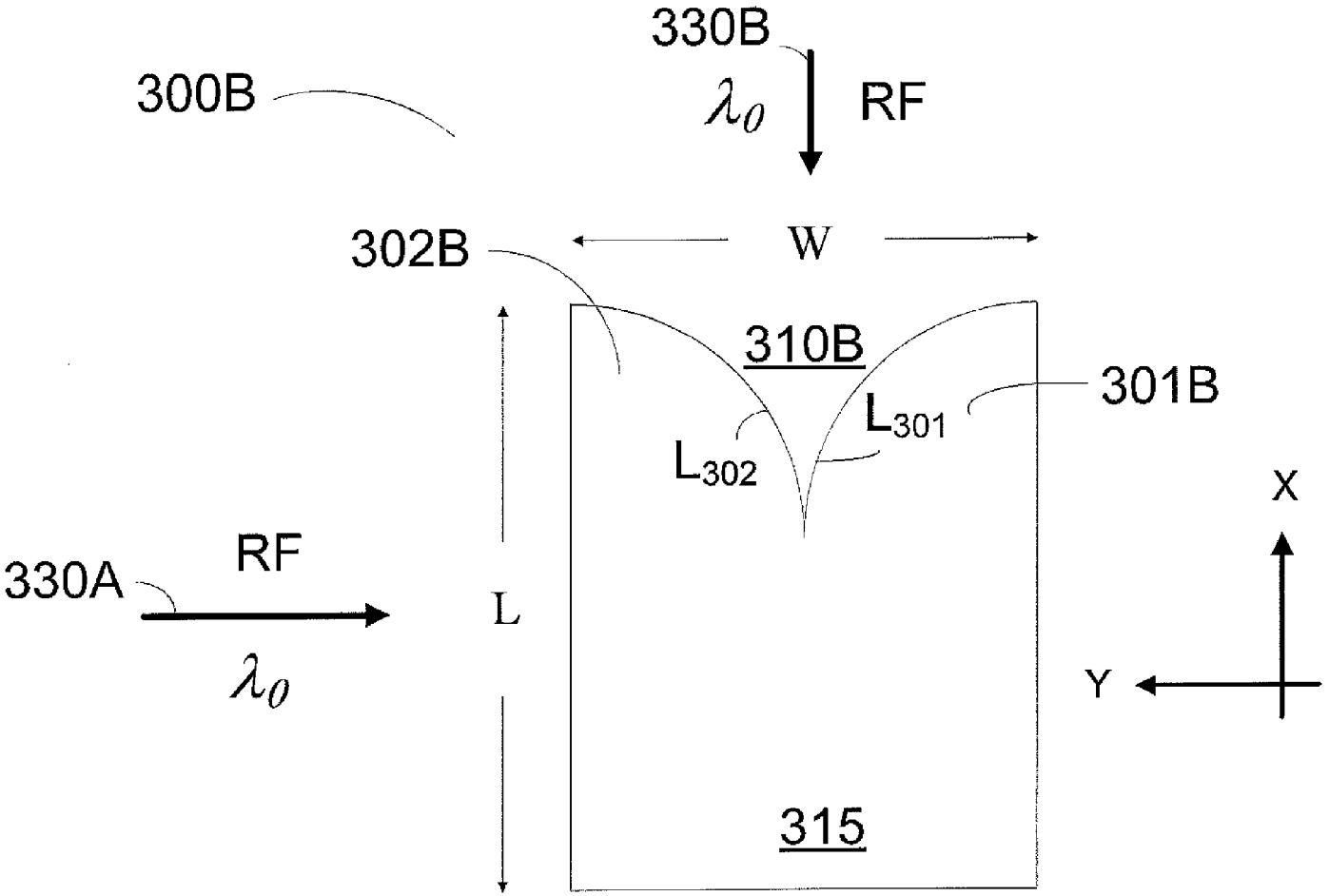
FIG. 3B illustrates a partial plan view of an omni-directional antenna, according to embodiments disclosed herein.

FIG. 3B illustrates an omni-directional antenna 300B, according to embodiments disclosed herein. In some embodiments, slit 310B in antenna 300B may have a curved shape, as illustrated in FIG. 3B. Sides L301 and L302 may be as described in detail above with respect to FIG. 3A. In some embodiments, sides L301 and L302 have a total length of approximately λe/4. Furthermore, sides L301 and L302 may have slightly different lengths and shapes, as discussed in detail above with respect to FIG. 3A.

Sides L301 and L302 in FIG. 3B show a continuously tapered separation. In some embodiments, the tapered shape has an exponential profile. In some embodiments, the tapered shape of sides L301 and L302 in slit 310B has a partially tangential (Tan (θ)) or a partially hyperbolic tangential (Tan h(θ)) profile. A smoothly varying taper as shown in slit 310B results in near uniform E field in the slit tip, and thus a better coupling efficiency for omni-directional antenna 300B. In some embodiments consistent with the present disclosure the shape and size of slit 300B may be used to determine the bandwidth of an omni-directional antenna. For example, a smoothly curved slit such as 310B may provide a broader RF bandwidth compared to a slit having straight edges, such as 310A.

FIGS. 3A and 3B illustrate RF signals 330A and 330B impinging on antennas 300A and 300B, according to some embodiments. RF signals 330A and 3308 may include an electric field polarized in the XY plane. For example, RF signal 330A may have an electric field polarized along the X-axis, and a wave traveling along the Y-axis. RF signal 330B may have an electric field polarized along the Y-axis and a wave traveling along the X-axis. According to embodiments consistent with the present disclosure, the response of antennas 300A and 3008 to RF signal 330A is enhanced by greater separation of lips 301A,B and 302A,B along the Y-axis (W). This is due to the greater phase delay of 330A signal impinging on 301A compared to signal impinging on 302A. Thus, when the separation of lips 301A,B and 302A,B (W) is comparable to λe/4, the antenna response is observed to be enhanced for RF signal 330A. In the case of RF signal 3308, the response of antennas 300A and 300B is governed by the projection of lengths L301 and L302 along the Y-axis, which is comparable to λe/4, according to embodiments disclosed herein. Thus, embodiments of antennas as disclosed herein provide enhanced coupling efficiency to radiation coming from multiple directions.

In embodiments of an omni-directional antenna as disclosed herein an electronic circuit may be laid on top of conductive layer 115 (cf. FIG. 1). Thus, a compact package may be obtained having space used for both antenna operation and the electric circuit operations.

In some embodiments, conductive layer 115 hosts electronic circuitry in a PCB assembly. Furthermore, antenna 100 may be provided on a multilayer PCB assembly according to some embodiments. Thus, appliance electronic circuitry may be placed above or below conductive layer 115. This will be described in detail below with reference to FIGS. 4A-4D.

Figure 4A:
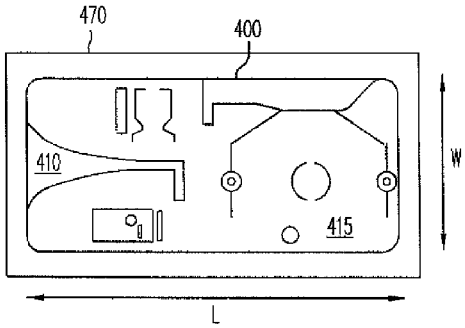
FIG. 4A illustrates a partial plan view of a multilayer PCB including a layer with an omni-directional antenna, according to embodiments disclosed herein.

FIG. 4A illustrates a partial plan view of a multilayer PCB 470 including a layer with an omni-directional antenna 400, according to embodiments disclosed herein. Omni-directional antenna 400 in FIG. 4A includes a conductive layer 415 and a slit 410. Conductive layer 415 and slit 410 may be as described in detail above in relation to conductive layer 115 and slit 110 in antenna 100 (cf. FIG. 1). Omni-directional antenna 400 may be an inner layer of multilayer PCB 470.

Figure 4B:
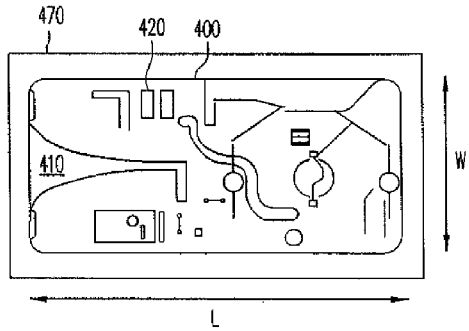
FIG. 4B illustrates a partial plan view of a multilayer PCB including a layer with an omni-directional antenna, according to embodiments disclosed herein.

FIG. 4B illustrates a partial plan view of multilayer PCB 470 including a layer with omni-directional antenna 400, according to embodiments disclosed herein. FIG. 4B illustrates an electronic circuit layer 420 laid on the PCB surface. In some embodiments, circuit layer 420 may be placed above omni-directional antenna 400. In some embodiments, circuit layer 420 may be placed below omni-directional antenna 400. Further, in some embodiments a first circuit layer 420 is placed above antenna layer 400, and a second circuit layer 420 is placed below antenna 400.

Figure 4C:
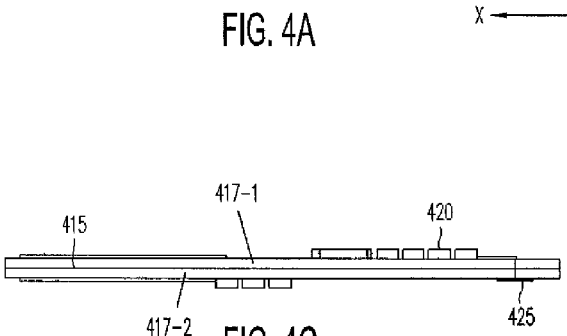
FIG. 4C illustrates a partial side view of a multilayer PCB including a layer with an omni-directional antenna, according to embodiments disclosed herein.

FIG. 4C illustrates a partial side view of a multilayer PCB 470 including a layer with omni-directional antenna 400, according to embodiments disclosed herein. When omni-directional antenna 400 is fabricated using a technique similar to that used for PCB, a metallic laminate used to realize conductive layer 415, 425 and 426 is surrounded by PCB substrate layers 417-1 and 417-2. According to some embodiments, substrate layers 417-1 and 417-2 are formed of a material with high dielectric constant (Dk). Slit 410 in omni-directional antenna 400 is formed of the same dielectric material Dk as substrate layers 417-1 and 417-2. This results in reduced velocity of wave propagation (compared to that in free space) by a factor of $1/\sqrt{D_K}$. However, since the dielectric material layer is thin compared to λDk, the net reduction of speed may not be so dramatic. The effective reduction in speed can be computed by CAD tools, to determine the actual size of copper laminate to construct the antenna. Thus the actual length L of omni-directional antenna 400 tends to be somewhat smaller than ½λ0. And the actual width W of omni-directional antenna 400 tends to be somewhat smaller than ¼λ0. For example, in embodiments consistent with the present disclosure, the actual length of omni-directional antenna 400 tends to be approximately equal to ½λe. And the actual width of omni-directional antenna 400 tends to be approximately equal to ¼λe. Having a material with a large value of Dk, it is typically found that λe<λ0. For example for use in 2.4 GHz Industrial, scientific and medical (ISM) band λ0=122.5 mm where as λe is approximately 119 mm.

Figure 4D:
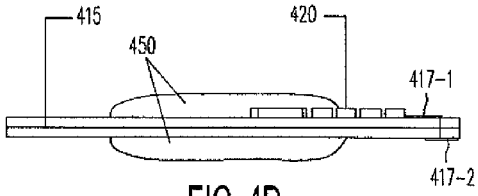
FIG. 4D illustrates a partial side view of a multilayer PCB including a layer with an omni-directional antenna, according to embodiments disclosed herein

FIG. 4D illustrates a partial side view of multilayer PCB 470 including a layer with omni-directional antenna 400, according to embodiments disclosed herein. Layers 415 and 420 in FIG. 4D are as described in detail above with respect to FIGS. 4A-4C. Embodiments consistent with the present disclosure may further include dielectric filler 450 in multilayer PCB 470. Dielectric filler layer 450 is a layer including a high dielectric constant (Dk) material. Thus, λe of an RF signal propagating through multilayer PCB 470 including dielectric layer 450, is reduced. A reduced λe allows for some embodiments of omni-directional antenna 400 to have a smaller profile, reducing length L and width W of multilayer PCB 470 (cf. FIG. 1).

In some embodiments, dielectric layer 450 includes a high Dk material in a middle section along the length L of multilayer PCB 470. Further, some embodiments consistent with the present disclosure may use a high Dk material for at least one of substrate layers 417-1 and 417-2 in multilayer PCB 470. Some embodiments may include a high dielectric material in a thicker dielectric layer 450 in addition to having high Dk material in substrate layers 417-1 and 417-2 and in slit 410. Material in layer 450 may be different from the material in substrate layers 417-1 and 417-2.

Some embodiments such as illustrated in FIG. 4D show dielectric layer 450 covering only a portion of the width W of multilayer PCB 470. Other embodiments may use dielectric layer 450 overlaying the entire length L and width W of multilayer PCB 470. Further, some embodiments may use more than one dielectric layer 450, with at least one of the layers overlaying the entire length L and width W of multilayer PCB 470, and at least one of the layers partially covering the area defined by length L and width W. Further according to some embodiments, layer 450 may include a thick enclosure surrounding the entire multilayer PCB 470, made of a high dielectric material.

Instead of planar antenna arrangement as shown in FIGS. 1-4D, some embodiments may include a three-dimensional (3D) antenna structure consistent with the present disclosure. For example, more than two lips 101 and 102 arranged in a 3D configuration may be used to receive an RF signal.

Embodiments using a multilayer PCB consistent with the present disclosure may be included in appliances using RF communication for more complex tasks. This includes for example RFID applications, RF sensor systems, security devices and locking devices such as used in door locking systems, phone, walkie-talkie, and others. Other appliances that may use omni-directional antennas embedded in a multilayer PCB configuration as disclosed here may include home automation devices, electronic locks, automatic billing and debiting system, and 'pay as you use' appliances. In the above examples, and in other configurations, an omni-directional antenna embedded in a multilayer PCB circuit is implemented for a system including a communication between two partners using an RE signal. The two partners may have wireless appliances including a transmitter and a receiver moving relative to one another. In some embodiments, one of the communication partners may be at a fixed position. Further in some embodiments one or both wireless appliances included in the communication partners acts as a transmitter and a receiver.

FIGS. 5A-5J illustrate a battery 525 placed within the layout of omni-directional antennas 500A-500J. Omni-directional antennas 500A-500J are Y-shaped antennas. Other common elements between omni-directional antennas 500A-500J in FIGS. 5A-5J are a conductive layer 515 having lips 501 and 502 formed by slits 510A-510J. A feed-point element 505 is also included in omni-directional antennas 500A-500J to couple an RF signal into an electrical circuit, for processing. Conductive layer 515, lips 501 and 502, and feed-point element 505 are as described in detail above with respect to conductive layer 115, lips 101 and 102, and feed-point element 105 (cf. FIG. 1).

Omni-directional antennas 500A-500H in FIGS. 5A-5H have a generally rectangular layout, with a length L and a width W as described in detail above (cf. FIG. 1). Thus, some embodiments of an omni-directional antenna consistent with the present disclosure have a length L approximately equal to λe/2, and a width W approximately equal to λe/4.

Figure 5B:
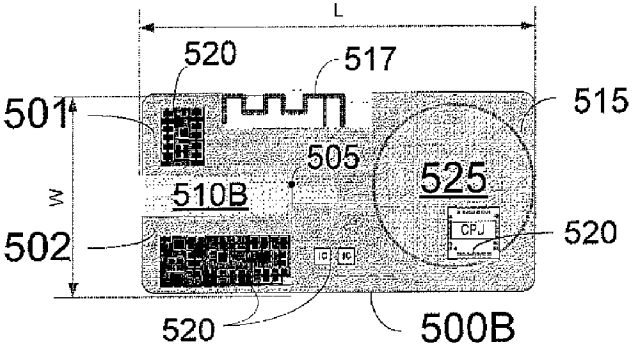
FIG. 5B illustrates a partial plan view of an omni-directional antenna including a second antenna and electronic circuits, according to embodiments disclosed herein.
Figure 5D:
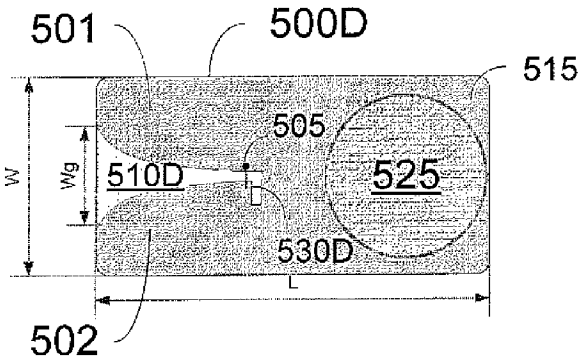
FIG. 5D illustrates a partial plan view of an omni-directional antenna including a slit having tangential-shaped sides and a bent tip, according to embodiments disclosed herein.
Figure 5A:
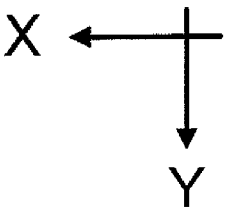
FIG. 5A illustrates a partial plan view of an omni-directional antenna, according to embodiments disclosed herein.
Figure 5A:
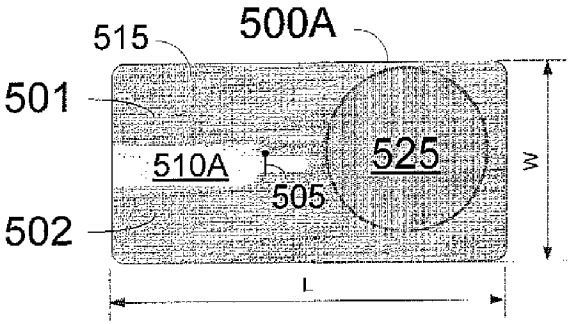

FIG. 5A illustrates a partial plan view of an omni-directional antenna 500A, according to embodiments disclosed herein. Omni-directional antenna 500A includes slit 510A made of linear segments. The linear segments of slit 510A are such that a wider portion is closer to the edge of omni-directional antenna 500A, and a narrower portion points to an inner point in omni-directional antenna 500A.

FIG. 5B illustrates a partial plan view of an omni-directional antenna 500B including a second antenna 517 and a plurality of electronic circuits 520, according to embodiments disclosed herein. Antenna 500B may be implemented on a multilayer PCB structure such as multilayer PCB 470 (cf. FIG. 4B above). Thus, electronic circuits 520 may be included in a circuit layer such as layer 420. Circuits 520 may include a CPU, processor chips such as 161 and 261 (cf. FIGS. 2A-2B), memory chips such as 162 and 262 (cf. FIGS. 2A-2B), and other ASICs. Circuits 520 may be configured to perform processing of the RF signal received by omni-directional antenna 500B. Processing of the RF signal received by omni-directional antenna 500B may include analogue and digital operations, according to embodiments consistent with the present disclosure. Furthermore, some embodiments may include in circuits 520 a radio circuitry configured to perform a multi-tiered signal processing for reducing power usage from battery 525. Circuits 520 in omni-directional antenna 500B may be configured to perform a multi-tiered signal processing circuit and method such as described in U.S. patent application Ser. No. 12/500,587, entitled "Low Power Radio Communication System," by Arun Kumar Sharma, filed on Jul. 9, 2009, the contents of which are hereby incorporated by reference in their entirety, for all purposes.

Omni-directional antenna 500B may also include a second antenna circuit 517. Antenna 517 may be configured to couple a different RE frequency than omni-directional antenna 500B, so that the two antennas do not interfere with each other. In further embodiments antenna 517 may be configured to couple an RF signal at a different polarization than the RF signal coupled by omni-directional antenna 500B.

Figure 5C:
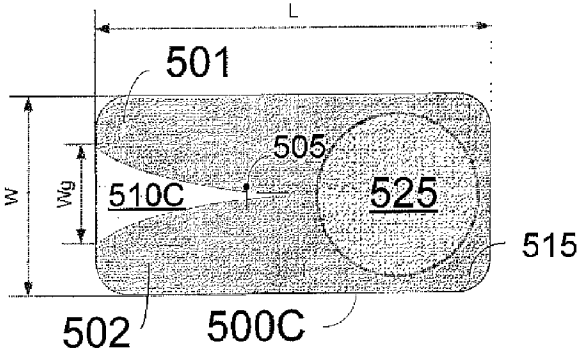
FIG. 5C illustrates a partial plan view of an omni-directional antenna including a slit having exponential-shaped sides, according to embodiments disclosed herein.

FIG. 5C illustrates a partial plan view of an omni-directional antenna 500C including a slit 510C having exponential-shaped sides, according to embodiments disclosed herein. FIGS. 5C-5J illustrate omni-directional antennas 500C-500J having smoothly tapered slits 510C-510J that may show an exponential profile or a tangential or hyperbolic tangential profile. Slits 510C-510J terminate in a mouth on a side of antennas 500C-500J. The mouth has a flare width Wg similar to that described in detail in relation to omni-directional antenna 100, above (cf. FIG. 1). Thus, slits 510C-510J may have Wg approximately equal to λe/8 according to some embodiments. In some embodiments, a non-linear tapered slit resembling slits 510C-510J is realized by a plurality of linear sections of varying length and width. The plurality of linear sections is selected to approximately describe a nonlinear-shaped taper.

In some embodiments, an omni-directional antenna having a smoothly tapered slit such as antennas 500C-500J may include a tapered shape that follows an exponential curve, a geometric ratio curve, a partial Tan (θ) curve, or a partial Tan h(θ) curve. A smoothly tapered slit resembling slits 510C-510J may follow any other monotonically increasing mathematical functions, including the above and combinations thereof.

An appliance including an omni-directional antenna as disclosed herein has a reduced size, as shown above. The area for circuitry that can be implemented on layers above and below the antenna in a multi-layer PCB can be further increased by reducing the slit length. A significantly greater circuit area can be realized for larger bulkier circuit components in an omni-directional antenna consistent with embodiments herein by different configurations such as described in more detail below with reference to FIGS. 5D-5G.

FIG. 5D illustrates a partial plan view of an omni-directional antenna 500D including a slit 510D having tangential-shaped sides and a bent tip 530D, according to embodiments disclosed herein. Meandering the tip opposite to the mouth having flare width Wg in slit 510D allows for extra space in the printed circuit board layout. The extra space may be used to place electrical components such as battery 525 overlaying conductive layer 515, as shown in FIG. 5D. Other elements that may be placed in the extra space created by meandering the tip in slit 510D may be another antenna, and circuits 520 (cf. FIG. 5B).

Figure 5F:
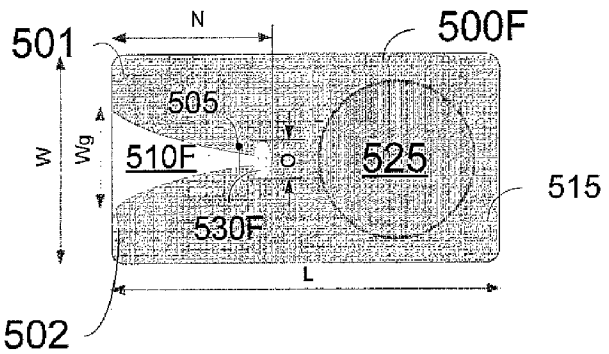
FIG. 5F illustrates a partial plan view of an omni-directional antenna including a round tip, according to embodiments disclosed herein.
Figure 5E:
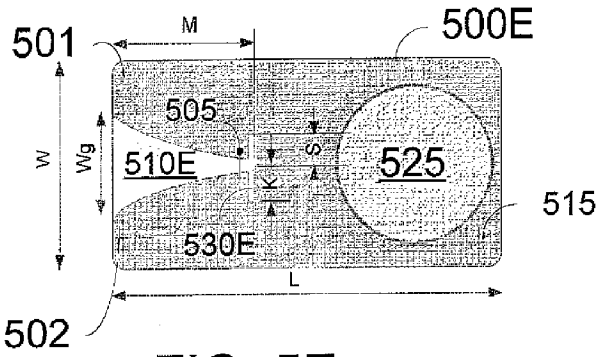
FIG. 5E illustrates a partial plan view of an omni-directional antenna including a doubly extended tip, according to embodiments disclosed herein.

FIG. 5E illustrates a partial plan view of an omni-directional antenna 500E including a doubly extended tip 530E, according to embodiments disclosed herein. According to some embodiments, tip 530E forms a T junction, thus extending the depth of slit 510E without reaching further along length L into the layout of omni-directional antenna 500E.

In FIG. 5E, slit 510E has a size Ls equal to M (cf. FIG. 1), where M<¼λe. Tip 530E forms a slot that extends the net electrical length of slit 510E. Tip 530E has a T shape with a first feature extending laterally by a distance K and a second feature extending laterally in the opposite direction by a distance S. According to some embodiments, M+(K+S)≈¼λe. Distances K and S may be the same, in some embodiments consistent with the present disclosure. In some embodiments also consistent with the above description, distances K and S may be different. In embodiments of omni-directional antenna 500E using a multilayer PCB circuit (cf. FIGS. 4A-4D) tip 530E frees a large portion of PCB space for placing large objects such as battery 525 or circuits 520.

FIG. 5F illustrates a partial plan view of an omni-directional antenna 500F including a round tip 530F, according to embodiments disclosed herein. According to some embodiments, tip 530F may have an elliptical profile.

In FIG. 5F the length Ls of slit 510F is equal to N, where N<¼λe. The perimeter of tip 530F extends the net electrical length of slit 510F. In some embodiments, the perimeter of round tip 530F is chosen such that N (perimeter of tip 530F)/2 is approximately equal to ¼λe. In embodiments where tip 530F is an ellipse, the ellipse can be of any eccentricity. In embodiments of omni-directional antenna 500F using a PCB circuit (cf. FIGS. 4A-4D) tip 530F allows large objects such as battery 525 or circuits 520 to be placed in portions of the PCB.

Figure 5H:
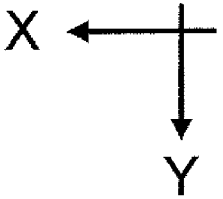
FIG. 5H illustrates a partial plan view of an omni-directional antenna, according to embodiments disclosed herein.
Figure 5H:
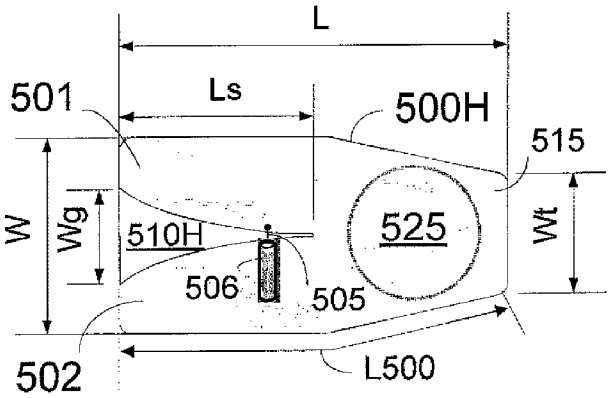
Figure 5G:
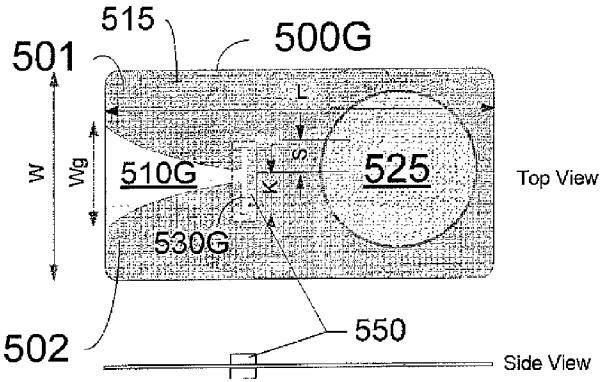
FIG. 5G illustrates a partial plan view and a side view of an omni-directional antenna including a doubly extended tip and a dielectric layer, according to embodiments disclosed herein.

FIG. 5G illustrates a partial plan view and a side view of an omni-directional antenna 500G including a doubly extended tip 530G and a dielectric layer 550, according to embodiments disclosed herein. According to some embodiments, tip 530G can be dielectric loaded by a dielectric layer 550, to further increase electrical length of slit 510G. In some embodiments a dielectric layer 550 is placed on top and on the bottom of tip 530G. The electrical length of slit 510G is increased by distances K and 5, and also by the high dielectric constant of the material in layer 550. Thus, slit 510G frees space in embodiments using a PCB circuit. In the freed space not covered by slit 510G, large objects such as battery 525 or circuits 520 may be placed.

FIG. 5H shows an embodiment that reduces the size of an omni-directional antenna 500H. According to embodiments consistent with the present disclosure, omni-directional antenna 500H maintains electrical propagation length along its length to be approximately ½λe. As a result, the profile of omni-directional antenna 500H has a reduced width Wt on the side opposite to the mouth of slit 510H. In embodiments consistent with the present disclosure slit 510H in omni-directional antenna 500H has a smooth shape similar to slits in 510C-510G. Further, according to some embodiments slit 510H may have an approximately curved shape formed by linear edge sections, consistent with the present disclosure.

Figure 5J:
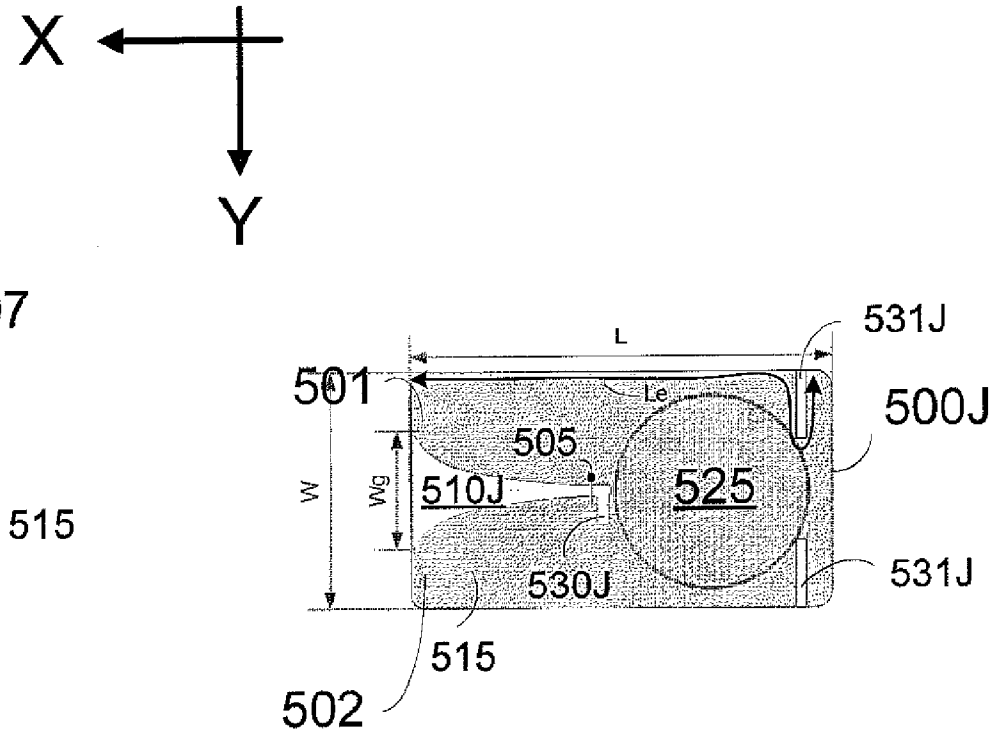
FIG. 5J illustrates a partial plan view of an omni-directional antenna including gaps, according to embodiments disclosed herein.
Figure 5I:
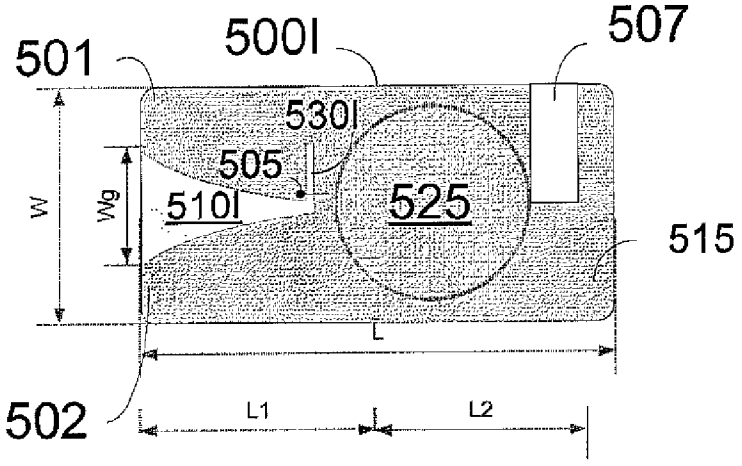
FIG. 5I illustrates a partial plan view of an omni-directional antenna including a slit having tangential-shaped sides and a gap, according to some embodiments disclosed herein.

FIG. 5I illustrates a partial plan view of an omni-directional antenna 500I including a slit 510I having tangential-shaped sides and a bent tip 530I, according to some embodiments disclosed herein. Omni-directional antenna 500I may also include a gap 507 in conductive layer 515. In some embodiments conductive layer 515 may have a shape folding on itself in the XY plane. This enables reduction of length L of omni-directional antenna 500I, while maintaining an electrical length approximately equal to $\lambda_e/2$ through conductive layer 515.

FIG. 5J illustrates a partial plan view of an omni-directional antenna 500I including gaps 531J, according to embodiments disclosed herein. According to embodiments consistent with the present disclosure gaps 531J reduce the length L of omni-directional antenna 500J. Gaps 531, cut out on conductive layer 515, maintain the electrical length Le of omni-directional antenna 500J by symmetrically extending (or meandering) conductive layer 515. In some embodiments conductive layer 515 may be folded on itself in the XY plane (cf. FIG. 5I).

Thus, embodiments consistent with the present disclosure include an omni-directional antenna having a length L significantly shorter than $\frac{1}{2}\lambda_e$ and a width W on one side significantly shorter than $\frac{1}{4}\lambda_e$. Some embodiments having a reduced omni-directional antenna size include one or more of the following features: a meandering of a conductive layer at the side opposite to a side having two lips separated by a dielectric slit; a high Dk material in a middle section of the conductive layer, along the length L of the conductive layer; a high Dk material forming the substrate of a multilayer PCB that includes the conductive layer; and a different high Dk material on the top and the bottom of the conducting layer.

Embodiments of an omni-directional antenna as disclosed herein exhibit distinctive radiation patterns. For an omni-directional antenna according to embodiments disclosed herein the combined signal strength from vertical polarization and horizontal polarization is nearly uniform in all directions. According to some embodiments, RF signals in vertical and horizontal polarization may be received and transmitted independently of one another. In some embodiments, the contribution of vertically polarized and horizontally polarized RF signals is added in 200A by the antennas 251 and 252, controlled by radio 250 and controller 263, while in other embodiment it is done in wireless appliance 150 by radio 170 and controller 163 with the help suitable communication protocol. This will be described in detail with reference to FIGS. 6A-6C, below.

Figure 6A:
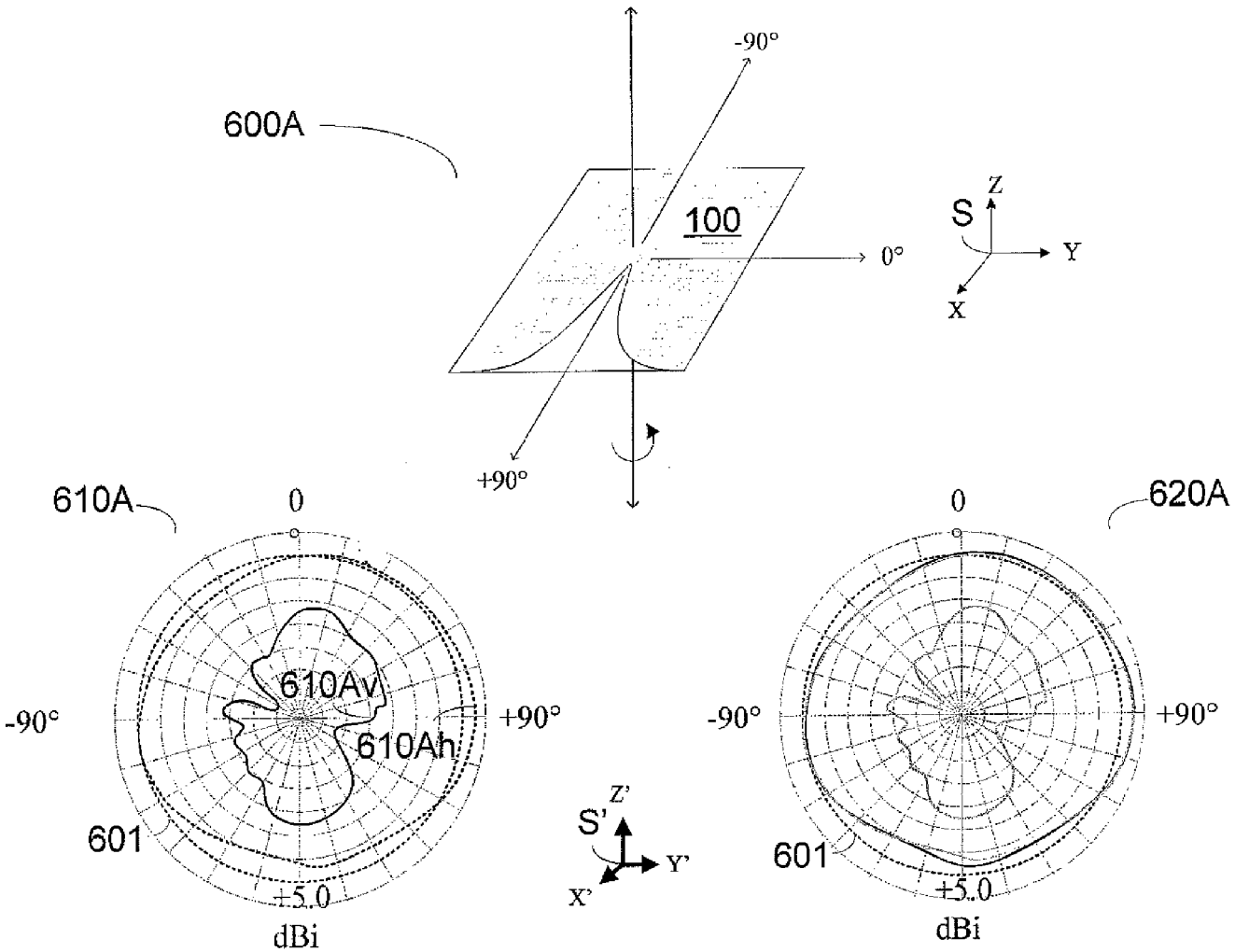
FIG. 6A illustrates a configuration of an omni-directional antenna receiving a signal from a radio emitter, and corresponding response plots.
Figure 6B:
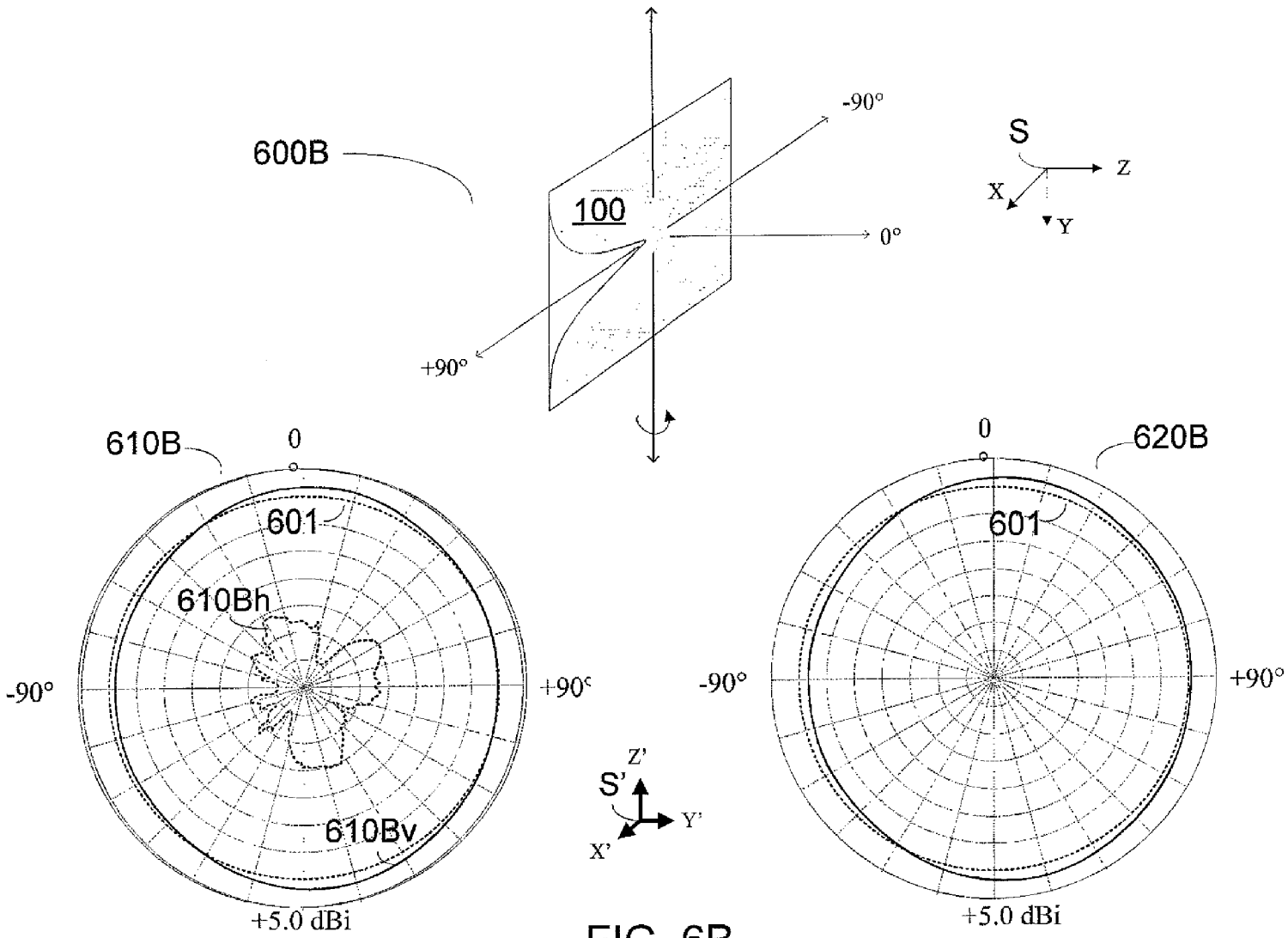
FIG. 6B illustrates a configuration of an omni-directional antenna receiving a signal from a radio emitter, and corresponding response plots.
Figure 6C:
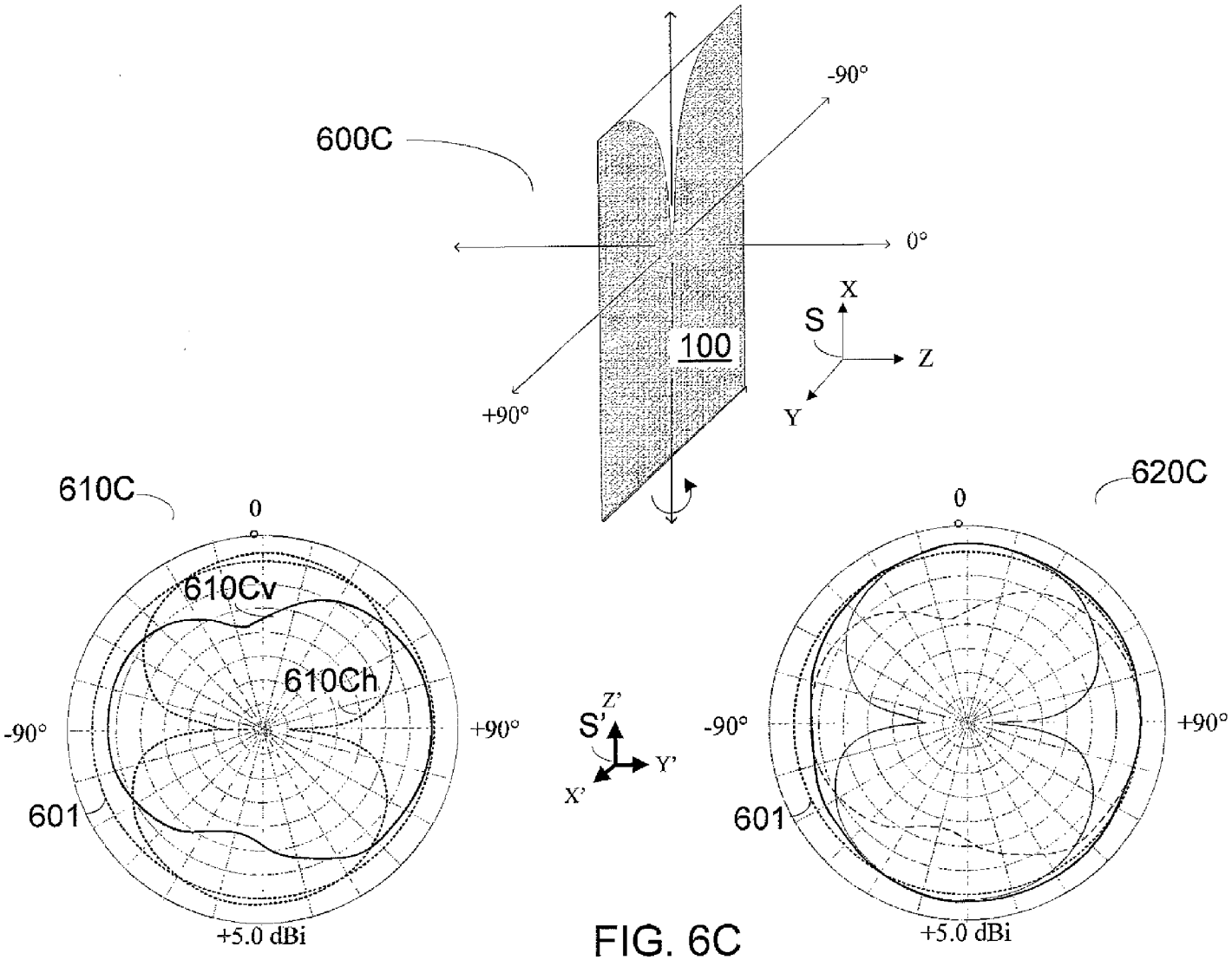
FIG. 6C illustrates a configuration of an omni-directional antenna receiving a signal from a radio emitter, and corresponding response plots.

FIGS. 6A-6C illustrate configurations 600A-600C of an omni-directional antenna 100 receiving a signal from a radio emitter, and corresponding response plots 610A-610C and 620A-620C. Configurations 600A-600C may be as illustrated in FIG. 2A using omni-directional antenna 100 and radio emitter 250 in wireless appliance 200A. As in FIG. 2A, reference frame S (XYZ) is fixed to antenna 100, and reference frame S' (X'Y'Z') is fixed to the radio emitter in wireless appliance 200A. Also as in FIG. 2A, the radio emitter produces a vertically polarized radiation and a horizontally polarized radiation. Hereinafter, vertically polarized radiation and horizontally polarized radiation are defined with reference to frame S'. While the radio emitter remains fixed at a certain position in space, omni-directional antenna 100 is rotated by 360° about its Z-axis (configuration 600A), about its Y-axis (configuration 600B), and about its X-axis (configuration 600C). According to embodiments consistent with FIGS. 6A-6C, the distance between a center point of omni-directional antenna 100 and the radio emitter is fixed.

Refer to FIGS. 6A, 6B and 6C. In configurations 600A-600C, the amplitude of an RF signal received by omni-directional antenna 100 from the radio emitter is plotted for every angle of rotation. Polar plots 610A-610C and 620A-620C are obtained, showing RF signal power (dBi) in a radial direction and the angle of rotation of omni-directional antenna 100 about the rotation axis in the azymuthal direction. A circle 601 in plots 610A-610C and 620A-620C at 0 dBi represents an isotropic antenna receiver. This is the ideal embodiment of an omni-directional antenna as disclosed herein. Polar plots 610A-610C include plots 610Av-610Cv and 610Ah-610Ch, respectively. Plots 610Av-610Cv correspond to the power measured by omni-directional antenna 100 when the radiation from the radio emitter is vertically polarized. Plots 610Ah-610Ch correspond to the power measured by omni-directional antenna 100 when the radiation from the radio emitter is horizontally polarized. Plots 620A-620C are sum plots: 620A=610Av+610Ah; 620B=610Bv+610Bh; and 620C=610Cv+610Ch; corresponding to sum of radiation from both horizontal polarization and vertical polarization.

In configuration 600A the rotation of omni-directional antenna 100 leaves the Z-axis of the S-frame unchanged relative to the S' frame. In particular, in embodiments consistent with configuration 600A the Z-axis of the rotating S-frame remains parallel to the Z-axis of the fixed S' frame.

According to plots 610A and 620A in configuration 600A, embodiments of an omni-directional antenna consistent with the present disclosure have a negligible vertical polarization response (610Av) because there is no physical metal in Z direction to allow Z reception when the antenna lies flat on the XY plane. Also in configuration 600A, a horizontal polarization response (610Ah) is close to ideal curve 601 for the +90° and −90° direction in omni-directional antennas according to embodiments disclosed herein. This is due to a bent dipole configuration of the two lips formed by a dielectric slit having a tip near the antenna feed-point point (cf. FIG. 1). Along the 0° and 180° direction the horizontal polarization response (610Ah) is good due to the $\frac{1}{2}\lambda e$ long virtual antenna elements separated by about $\frac{1}{4}\lambda e$ propagation phase difference (omni-directional antenna width, W, cf. FIG. 1).

FIG. 6B illustrates a configuration 600B of an omni-directional antenna 100 receiving a signal from a radio emitter, and corresponding response plots 610B and 620B. In configuration 600B the rotation of omni-directional antenna 100 leaves the Y-axis of the S-frame unchanged relative to the S' frame. In particular, in embodiments consistent with configuration 600B the Y-axis of the rotating S-frame remains anti-parallel to the Z'-axis of the fixed S' frame.

According to plots 610B and 620B in configuration 600B, embodiments of an omni-directional antenna consistent with the present disclosure have a uniform vertical polarization response (610Bv). The radiation pattern is similar to a bent dipole (cf. FIG. 3A-3B) created by the two lips formed by the slit. Each lip of length approximately $\frac{1}{4}\lambda e$ converges near the feed-point point, creating a bent dipole of length $\frac{1}{4}\lambda e$ with vertex near the feed-point point. In such configurations, a half dipole at the desired RF frequency ($\lambda e$) is formed with arms bent towards each other and a vertex near the feed-point point. This makes the antenna's directional response close to curve 601 in the XZ plane. This matches the supplementary antenna response from other orientations and polarizations, rendering a response close to curve 601. Also in configuration 600B a horizontal polarization response (610Bh) is negligible because the feed point is at an equi-potential surface even if the antenna resonates along its length L (approximately $\frac{1}{2}\lambda e$).

FIG. 6C illustrates a configuration 600C of an omni-directional antenna 100 receiving a signal from a radio emitter, and corresponding response plots 610C and 620C. In configuration 600C the rotation of omni-directional antenna 100 leaves the X-axis of the S-frame unchanged relative to the S' frame. In particular, in embodiments consistent with configuration 600C the X-axis of the rotating S-frame remains parallel to the Z-axis of the fixed S' frame.

According to plots 610C and 620C in configuration 600C, embodiments of an omni-directional antenna consistent with the present disclosure have a horizontal polarization response similar to a figure '8' (610Ch). Thus, in the +0° and −180° directions antenna response is close to ideal curve 601 (0 dBi) for embodiments consistent with the present disclosure. In particular, omni-directional antennas as disclosed herein having a bent dipole formed by the two lips with a length approximately equal to ¼λe with the antenna feed-point point near the vertex. The bent dipole hence responds well when it faces the horizontal polarization emitter in 0° and 180° direction. Also in configuration 600C a vertical polarization response (610Cv) is close to curve 601 in the +90° and −90° directions. In particular, in embodiments of an omni-directional antenna as disclosed herein curve 610Cv is close to curve 601 at orientations where curve 610Ch departs from curve 601 (i.e. it complements the Horizontal polarization radiation pattern). Along the +90° and −90° direction the vertical polarization response is close to curve 601 in embodiments with omni-directional antenna having a length L approximately equal to ½λe, with lips separated by a width W of about ¼λe. In such embodiments, the width W of the antenna is comparable to the propagation phase difference of an RF signal with effective wavelength λe; that results in good antenna response in end fire orientation. 620C shows the combined radiation pattern response due to sum of both polarization, and it is close to deal curve 601.

Irrespective of the different configurations 600A-600C, the sum of the omni-directional antenna response for vertical and horizontal polarization is similar to ideal curve 601. This is shown in curves 620A-620C. An omni-directional antenna consistent with embodiments disclosed herein may include a partner emitting horizontally and vertically polarized radiation. In such configuration the antenna response is uniform regardless of the antenna orientation relative to a LoS between antenna and radio emitter. Curves 620A-620C illustrate the omni-directional nature of an antenna and a wireless communication system consistent with embodiments disclosed herein.

Figure 7B:
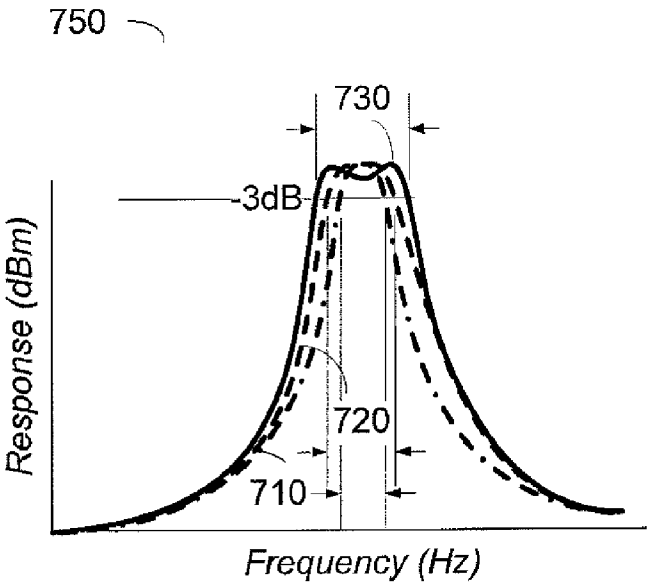
FIG. 7B illustrates a signal response spectrum for resonance structures coupled to one another under different configurations, according to embodiments disclosed herein.
Figure 7A:
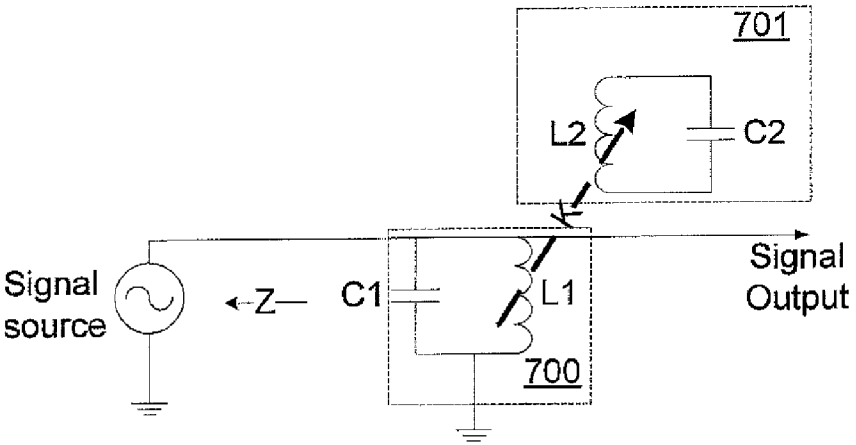
FIG. 7A illustrates a schematic view of resonance structures coupled to one another, according to embodiments disclosed herein.

FIG. 7A illustrates a schematic view of resonance structures 700 and 701 coupled to one another, according to embodiments disclosed herein. Structures 700 and 701 are schematically represented as resonant LC circuits. According to embodiments disclosed herein, structure 700 may be coupled to a signal source and return a signal output, as shown. Structure 700 is tuned to a first resonance frequency determined by design factors such as the values for inductance L1 and capacitance C1. The presence of resonance structure 701 tuned to a second resonant frequency may alter the frequency response obtained at the signal output from structure 700. For example, the bandwidth of the first resonance frequency in the signal output may be altered. The second resonant frequency is determined by design factors such as the values for inductance L2 and capacitance C2. The alteration of the frequency response in signal output is generally governed by a coupling factor K. The value of K depends on the geometric configuration of structures 700 and 701, such as distance and relative orientation. The value of K also depends on the frequency response of each structure 700 and 701 taken independently of one another. For example, the relative values of the first resonance frequency and the second resonance frequency may determine the value of K. Also, the bandwidth of the first resonance response and the bandwidth of the second resonance response may affect the value of K. In general, the value of K is a function of the frequency selected to measure the signal output. In some embodiments consistent with the present disclosure at least one of resonant structures 700 and 701 may be an omni-directional antenna, or any other type of antenna configured to receive an RF signal.

FIG. 7B illustrates a signal response spectrum graph 750 for resonance structures coupled to one another under different configurations, according to embodiments disclosed herein. Graph 750 includes an abscissa for Frequency (Hz) and an ordinate for Response amplitude (dBm). FIG. 7B illustrates the broadening of a first antenna's bandwidth by having another resonant structure proximal to the first antenna, such as a second antenna. A coupling of the two antennas generally results in a broadening of the first antenna bandwidth. The specific amount of broadening depends on the value of the coupling factor K. For a low value of K, the signal response of a first antenna may be largely unaffected by the presence of the second antenna, showing a response curve 710 similar to that of a standalone first antenna. Two antennas tuned to the same resonance, in close proximity, may be critically coupled when the value of K reaches a critical value Kc. In some embodiments critical value Kc may be a coupling value such that the 3 dB bandwidth response of the first antenna is doubled compared to the 3 dB bandwidth of a stand alone antenna. In such scenario, the first antenna may show a broadened response curve 720. Further according to some embodiments, the value of K may exceed the value of Kc, in which case a broadened response curve 730 may result.

The layout of omni-directional antennas as disclosed herein lends itself to implementing two (or more) antennas on a common PCB (antenna surface). The plurality of antennas may be tuned to the same resonance frequency or to different resonance frequencies. Thus, embodiments consistent with the present disclosure support applications and appliances configured for multiple antenna operation. This will be described in detail with reference to FIGS. 8A-8F, below.

Figure 8A:
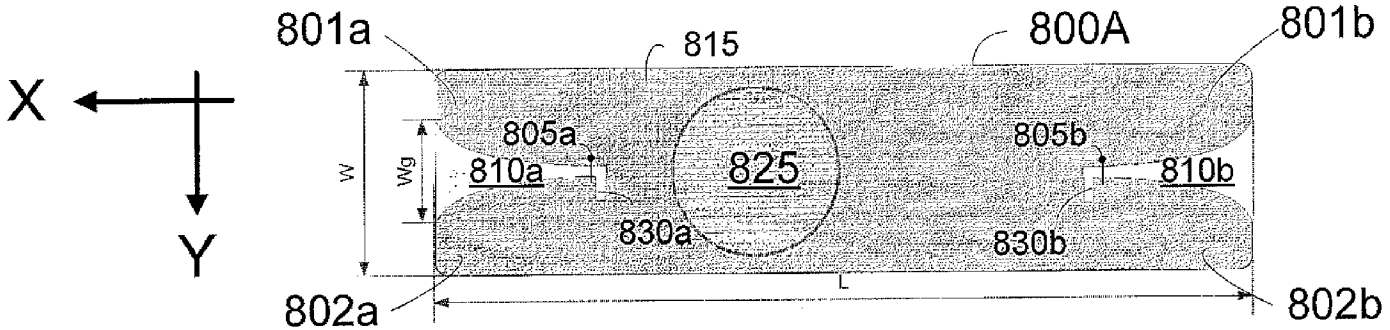
FIG. 8A illustrates a partial plan view of a dual omni-directional antenna including two slits, according to embodiments disclosed herein.
Figure 8C:
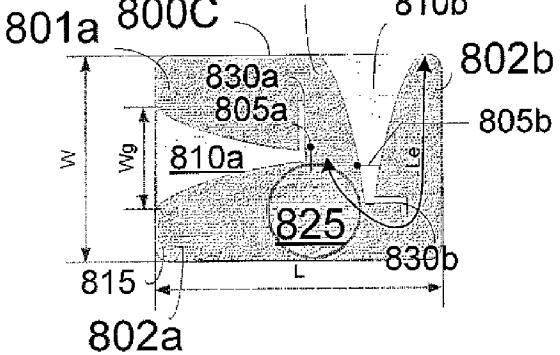
FIG. 8C illustrates a partial plan view of a dual omni-directional antenna including two slits, according to embodiments disclosed herein.
Figure 8B:
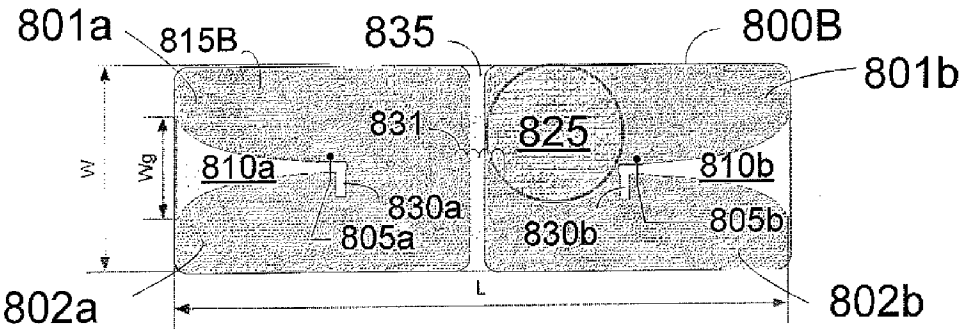
FIG. 8B illustrates a partial plan view of a dual omni-directional antenna including two slits and a reactive component, according to embodiments disclosed herein.
Figure 8E:
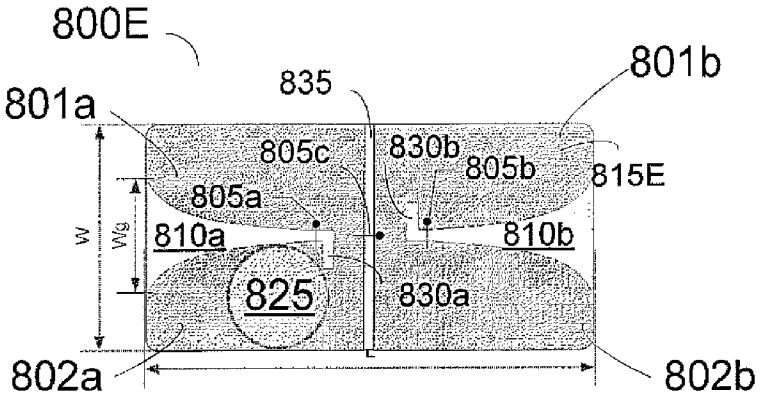
FIG. 8E illustrates a partial plan view of a triple omni-directional antenna including two slits, according to embodiments disclosed herein.
Figure 8D:
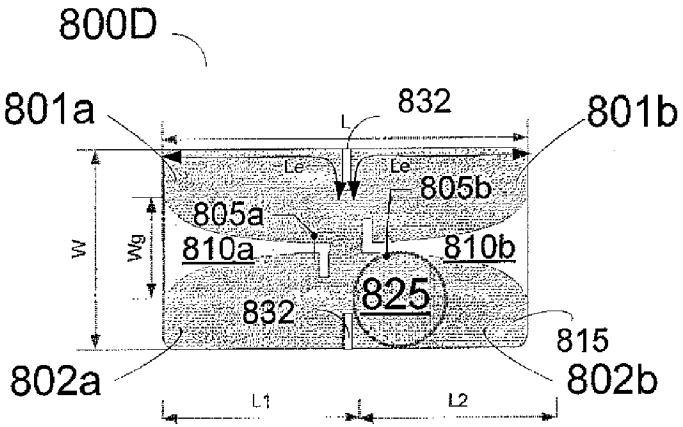
FIG. 8D illustrates a partial plan view of a dual omni-directional antenna including two slits, according to embodiments disclosed herein.

FIGS. 8A-8D illustrate a partial plan view of dual omni-directional antennas 800A-800D including two slits 810*a* and 810*b*, according to embodiments disclosed herein. In FIGS. 8A-8D each one of slits 810*a* and 810*b* defines a first Y-shaped antenna (810*a*) and a second Y-shaped antenna (810*b*). Slits 810*a* and 810*b* include bent tips 830*a* and 830*b* to reduce Ls while accommodating for an effective electrical length Le. The first and second Y-shaped antennas in FIGS. 8A & 8D are implemented on a common conducting surface 815. Feed-point elements 805*a* and 805*b* couple the RF signals from the first and second Y-shaped antennas, respectively. The specific shape of slits 810*a* and 810*b* may be a continuous taper following a nonlinear curve such as an exponential curve, a tangential curve, or a hyperbolic tangential curve (cf. FIG. 5C-5H). Furthermore, at least one of slits 810*a* or 810*b* may include linear portions (cf. FIG. 5A-5B). Dual omni-directional antennas 800A-800D are spatially arranged so as to provide space for battery 825 overlaying conductive layer 815. In some other embodiment the two Y-shaped antennas could operate at different frequencies.

FIG. 8A shows an embodiment that has two tapered slits 810*a* and 810*b* symmetrically opposite each other. Dual omni-directional antenna 800A has a length L allowing for slits 810*a* and 810*b* to be placed longitudinally. In some embodiments, the length L of omni-directional antenna 800A is an integral multiple of ½λe.

FIG. 8B illustrates a partial plan view of an omni-directional antenna 8008 including slits 810*a* and Blob, and a reactive component 831, according to embodiments disclosed herein. Slits 810*a* and 810*b* in dual omni-directional antenna 8008 are symmetrically opposite each other. According to embodiments consistent with the present disclosure, the length L of dual omni-directional antenna 8008 allows for slits 810*a* and 810*b* to be placed longitudinally. The length L of dual omni-directional antenna may be greater than ½λe and smaller than 3/2λe, according to some embodiments. Conductive layer 815B is split in two via dielectric channel 835, and additional phase shift provided by a reactive component 831. In some embodiments, reactive component 831 may be a discrete or distributed inductor, or a transmission line.

FIG. 8C illustrates a partial plan view of a dual omni-directional antenna 800C including slits 810*a* and 810*b*, according to embodiments disclosed herein. Slits 810*a* and 810*b* in dual omni-directional antenna 800C are oriented perpendicular to each other. Feed-point 805*b* of the second antenna in FIG. 8C is meandered to provide an effective electrical length of approximately ½λe. Thus, slit 810*b* makes a dipole with lips 801*b* and 802*b*.

FIG. 8D illustrates a partial plan view of a dual omni-directional antenna 800D including slits 810*a* and 810*b*, according to embodiments disclosed herein. In FIG. 8D slits 810*a* and 810*b* are symmetrically opposite to each other along the length L of dual omni-directional antenna 800D. FIG. 8D embodies a method to reduce the length L of dual omni-directional antenna 800D using gaps or notch-cutouts 832. Thus, embodiments consistent with the present disclosure maintain the effective electrical propagation length Le of the dipole by extending (meandering) the propagation path around notch cutouts 832.

FIG. 8E illustrates a partial plan view of a triple omni-directional antenna 800E including slits 810*a* and 810*b*, according to embodiments disclosed herein. In triple omni-directional antenna 800E slits 810*a* and 810*b* form two Y-shaped antennas symmetrically opposite each other. A third dipole antenna is created in the middle of the layout by splitting conductive layer 815E in two, with dielectric channel 835. Dielectric channel 835 may be formed of the same high Dk material as slits 810*a* and 810*b*. A feed-point 805*c* couples the RF signal captured by the dipole antenna into an electric circuit. Feed-point elements 805*a* and 805*b* couple the RF signals from the first and second omni-directional antennas, respectively. The third antenna is practically only a dipole antenna, and could be operated at a frequency that is different from the other two omni-antennas.

Figure 8F:
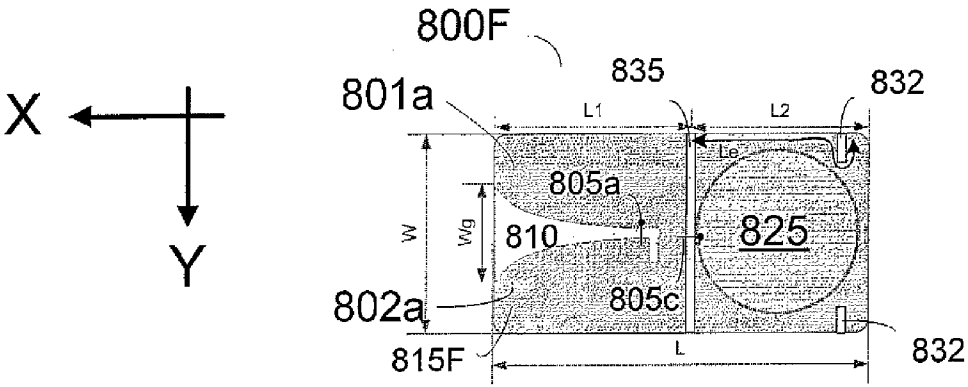
FIG. 8F illustrates a partial plan view of a dual omni-directional antenna including on slit, according to embodiments disclosed herein.

FIG. 8F illustrates a partial plan view of a dual antenna 800F formed by slits 810*a* and 835, according to embodiments disclosed herein. Dual antenna 800F includes a omni-directional formed by slit 810 on the left side and a dipole antenna in the middle. This is accomplished by splitting conductive layer 815F with channel 835 and coupling the RF signal with feed-point element 805*c*. Some embodiments may include notch-cutout elements 832. Thus, dual omni-directional antenna 800F may have a reduced layout length L, maintaining electrical propagation length Le by symmetrically extending (meandering) the tail and folding on itself, around notch-cutouts 832.

Figure 9:
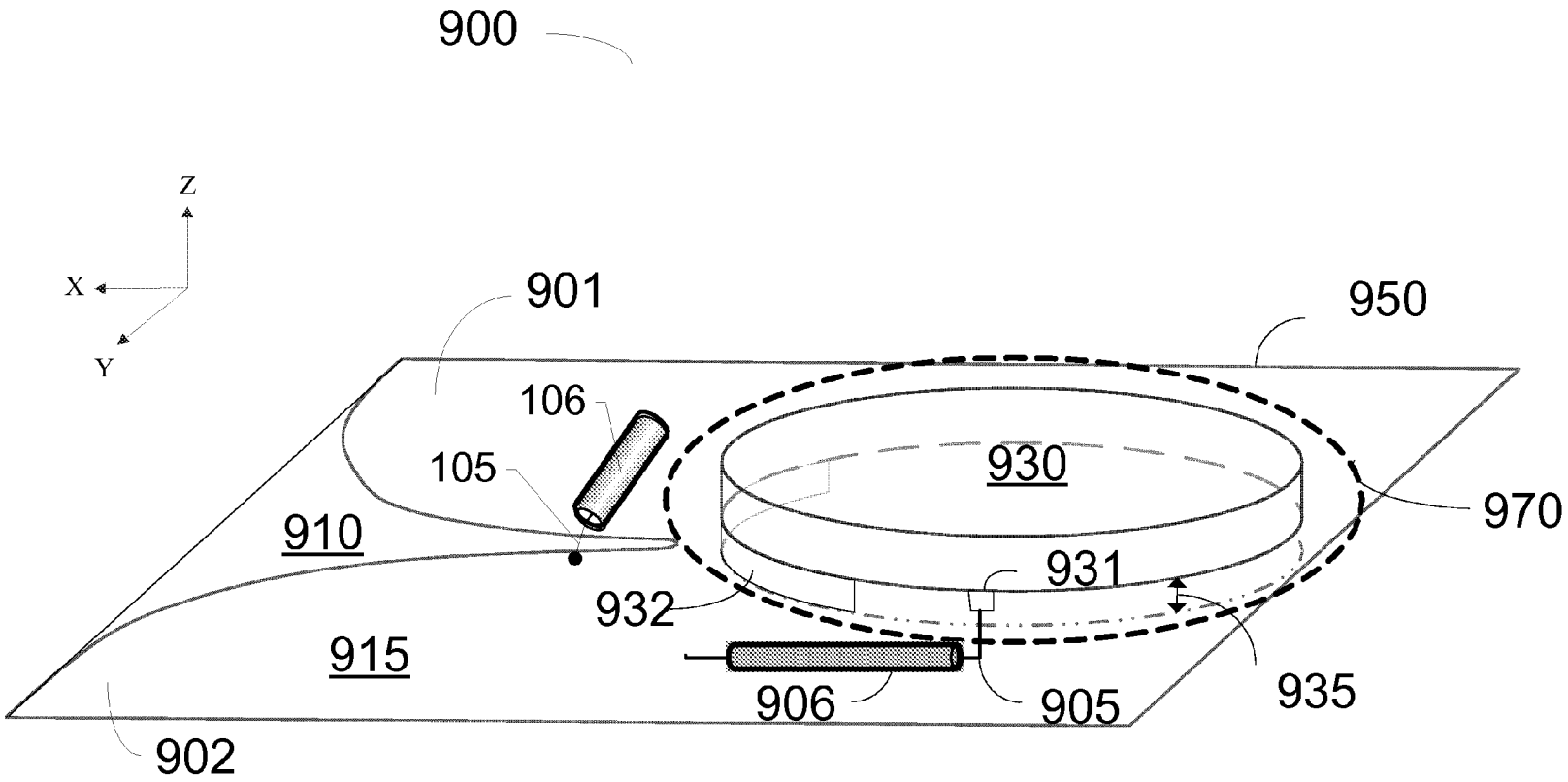
FIG. 9 illustrates a partial perspective view of a dual omni-directional antenna including a Y-shaped antenna and an F-slot antenna, according to embodiments disclosed herein.

FIG. 9 illustrates a partial perspective view of a dual omni-directional antenna 900 including a Y-shaped antenna 950 and an F-slot antenna 970, according to embodiments disclosed herein. For antenna diversity, compact vertical hybrid F-Slot antenna 970 formed by a metal disc 930 is located next to Y shaped antenna 950 having dielectric slit 910 forming lips 901 and 902 in conductive layer 915. Y-shaped antenna 950 operates similarly to what has been described in detail above with respect to omni-directional antenna 100 (cf. FIG. 1). In embodiments consistent with the present disclosure, no detuning or interference is introduced by F-slot antenna 970 due to close proximity with Y-shaped antenna 950. F-slot antenna 970 provides coupling to vertically polarized RF signals (along the Z-axis in the S-frame) between disc plate 930 and conductive layer 915. Plate 930 and conductive layer 915 are separated by gap 935. The signal from F-slot antenna 970 is coupled to coaxial element 906 by feed-point element 905, which makes electric contact with conducting plate 930 at feed point 931.

In some embodiments, F-slot antenna 970 is realized by configuring a small dielectric space as gap 935, and configuring a metallic part of the appliance (e.g. coin cell battery) as plate 930. Thus, a conducting layer 915 becomes the antenna ground plane. According to embodiments disclosed herein, a portion 932 of the perimeter of conducting plate 930 is connected to a ground plane. In such embodiments, the perimeter of plate 930 facing gap 931 forms an aperture of size comparable to ½λe, acting as a slot antenna for vertically polarized radiation (along the Z-axis).

The precise location of feed point 931 is determined by suitably matching the impedance of the system. In some embodiments, a CAD tool is used to find a suitable location for feed point 931 in order to maximize coupling efficiency at a desired RF wavelength. In some embodiments, a VNA may be used to iteratively determine the position of feed point 931 using a physical prototype consistent with the present disclosure.

According to embodiments consistent with the present disclosure F-slot antenna 970 is not open on both sides. As a result, the resonance frequency is not same as in a classical slot antenna of comparable dimensions that is open on both sides of the slot. The antenna arrangement and feed structure as in F-slot antenna 970 shows a hybridized behavior of both a classical slot antenna and an inverted F antenna.

The resonant frequency of F-slot antenna 970 can be adjusted by changing the dielectric constant of the material forming gap 935. In general, increasing the dielectric constant of the material reduces the resonance frequency of F-slot antenna 970. In some embodiments, the resonance frequency of F-slot antenna 970 may be adjusted placing a shorting pin between conductive plate 930 and conductive layer 915 in the interior part of gap 935. In some embodiments, the shorting pin could be the negative contact pin of the battery connector that connects the negative contact of a battery to conducting plate 915. In such configurations, the resonance frequency of F-slot antenna 970 is increased. F-slot antenna 970 exhibits omni-directional response (on the XY plane) for vertically polarized radiation (along Z-axis).

Embodiments of an F-slot antenna consistent with the present disclosure may be used stand alone. In dual omni-directional antenna 900, F-slot antenna 970 is placed such that negligible coupling results between Y-shaped antenna 950 and F-slot antenna 970. F-slot antenna 970 excites current in conducting layer 915 such that it has little coupling with Y shaped antenna 950. Thus, embodiments consistent with the present disclosure include a Y-shaped antenna 950 and an F-slot antenna 970 that co-exist without mutual detuning or interference.

Figure 10:
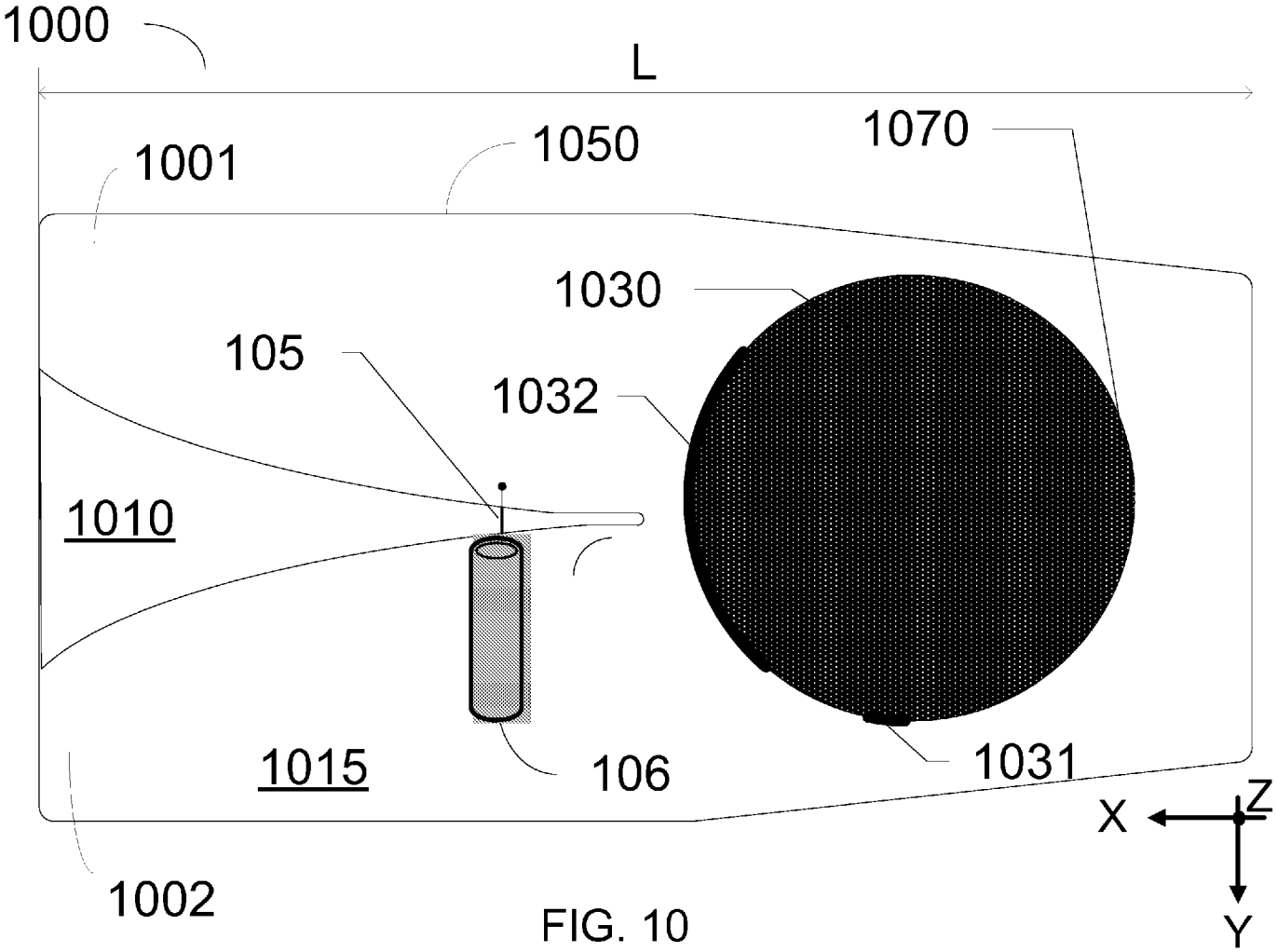
FIG. 10 illustrates a partial plan view of a dual omni-directional antenna including a Y-shaped antenna and an F-slot antenna, according to embodiments disclosed herein.

FIG. 10 illustrates a partial plan view of a dual omni-directional antenna 1000 including a Y-shaped antenna 1050 and an F-slot antenna 1070, according to embodiments disclosed herein. Y-shaped antenna 1050 and F-slot antenna 1070 operate in a manner similar to Y-shaped antenna 950 and F-slot antenna 970 described in detail in FIG. 9. Thus, F-slot antenna 1070 includes conductive plate 1030 separated from conductive layer 1015. F-slot antenna 1070 also includes portion 1032 connecting conductive plate 1030 to conductive layer 1015. F-slot antenna 1070 includes feed point 1031. Dual omni-directional antenna 1000 includes a profile with a reduced total length L by adding a bend to the side of conductive layer 1015 (cf. antenna 500H in FIG. 5H).

According to embodiments consistent with the present disclosure, Y-shaped antenna 1050 and F-Slot Antenna 1070 may be included in a single PCB.

In some embodiments, a dual omni-directional antenna as disclosed herein may be formed by an F-slot antenna directly overlaying a Y-shaped antenna. In such configurations, detuning of the Y-shaped antenna and the F-slot antenna due to close proximity will be negligible for the reasons given above in relation to FIG. 9. Detuning between a Y-shaped antenna and an F-slot antenna is negligible.

As described in relation to FIG. 9, F-slot antenna 1070 exhibits omni-directional responsivity along the XY plane for vertically polarized radiation. Vertically polarized radiation points along the Z-axis, out of the plane in FIG. 10.

Figure 11:
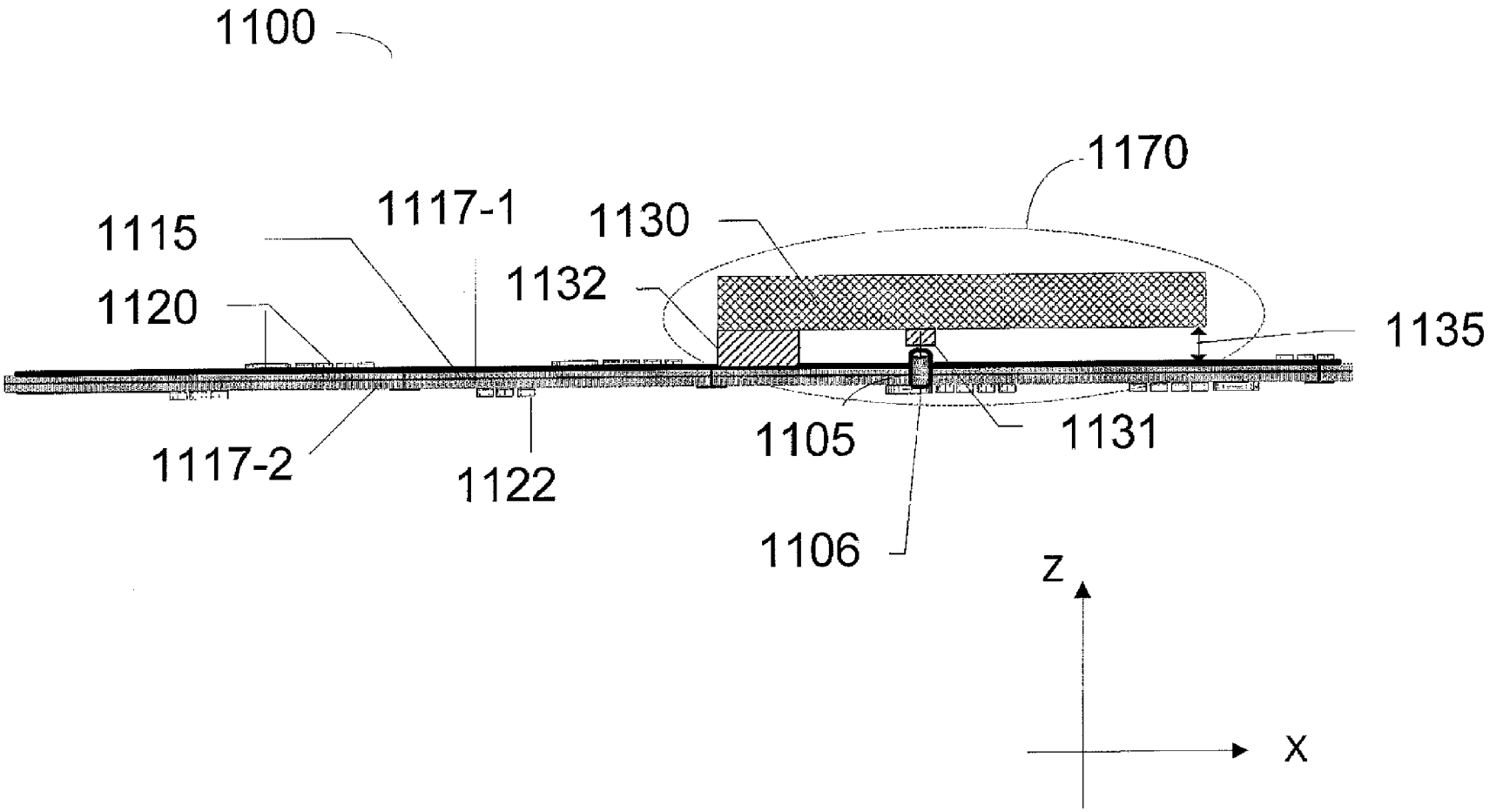
FIG. 11 illustrates a partial side view of a PCB antenna circuit including an F-slot antenna, according to embodiments disclosed herein.

FIG. 11 illustrates a partial side view of PCB antenna circuit 1100 including an F-slot antenna 1170, according to embodiments disclosed herein. Features of F-slot antenna 1170 shown in FIG. 11 include conductive plate 1130, gap 1135, side wall contact 1132, feed point 1131, and conductive layer 1115. Analogous features have been described in detail above with reference to F-slot antenna 1070 in FIG. 10. According to some embodiments, an F-slot antenna such as illustrated in FIG. 11 may include a multilayer PCB including PCB substrate layers 1117-1 and 1117-2 surrounding conductive layer 1115. Substrate layers 1117-1 and 1117-2 may be as described in detail above with respect to layers 417-1 and 417-2 (cf. FIG. 4C). Circuit layer 1120 includes circuit elements as described in detail above in relation to circuit layer 420 (cf. FIG. 4B-4D). PCB antenna circuit 1100 may further include circuit elements 1122 placed on the bottom of the multilayer PCB device.

Figure 12:
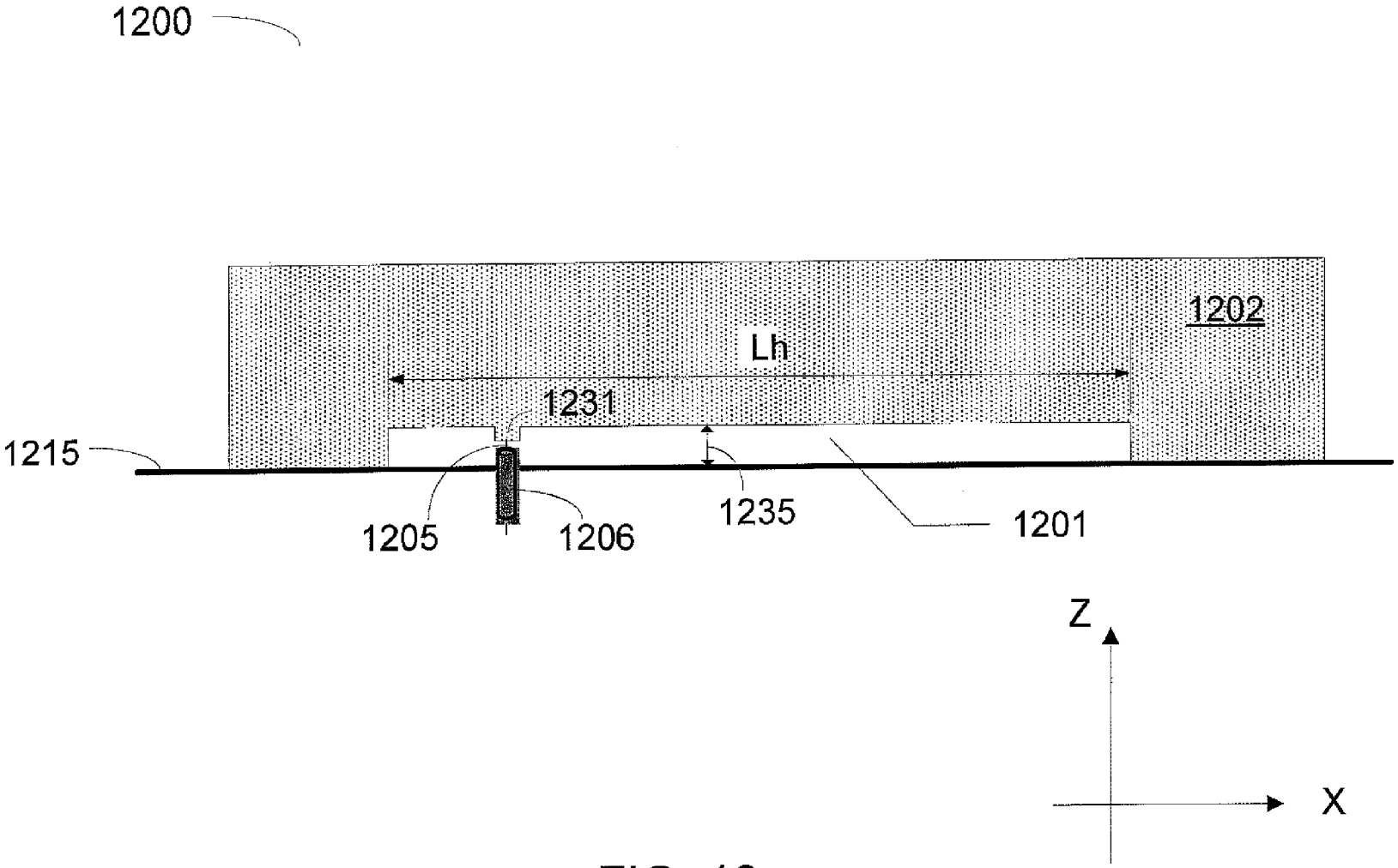
FIG. 12 illustrates a partial plan view of an F-slot antenna according to embodiments disclosed herein.

FIG. 12 illustrates a conceptual view of an F-slot antenna 1200 according to embodiments disclosed herein, of the slot formed by flattening out the curved slot in a flat 2D plane like a conventional slot antenna that is open on both sides. F-slot antenna 1200 includes slot 1201 formed on a conductive plate 1202 on one side of slot 1201 and a ground element 1215 on another side of slot 1201. One can understand a simplified behavior of the antenna by accounting for capacitive loading of parallel plates forms by 930 and 915 that is shorted on one end by shunting wall 932. Slot 1201 has a profile given by a gap size 1235 and a length Lh along the perimeter of 930. An RF signal impinging on F-slot antenna 1200 resonates with the slot structure and creates an electric field that is coupled into coaxial cable 1206 via feed-point element 1205 from feed point 1231. The precise location of feed point 1231 for an efficient RF signal coupling may be found using a CAD tool for simulating the RF electric field coupled into slot 1201. According to embodiments consistent with the present disclosure an F-slot antenna may be realized by folding plate 1202 on itself so that the left hand side joins the right hand side. Furthermore, in order to increase the wavelength of the RF signal coupled to the folded F-slot antenna, a conductive plate may be placed in the top, thus resulting in a structure similar to F-slot antennas 970, 1070, and 1170 (cf. FIGS. 9-11).

Figure 13:
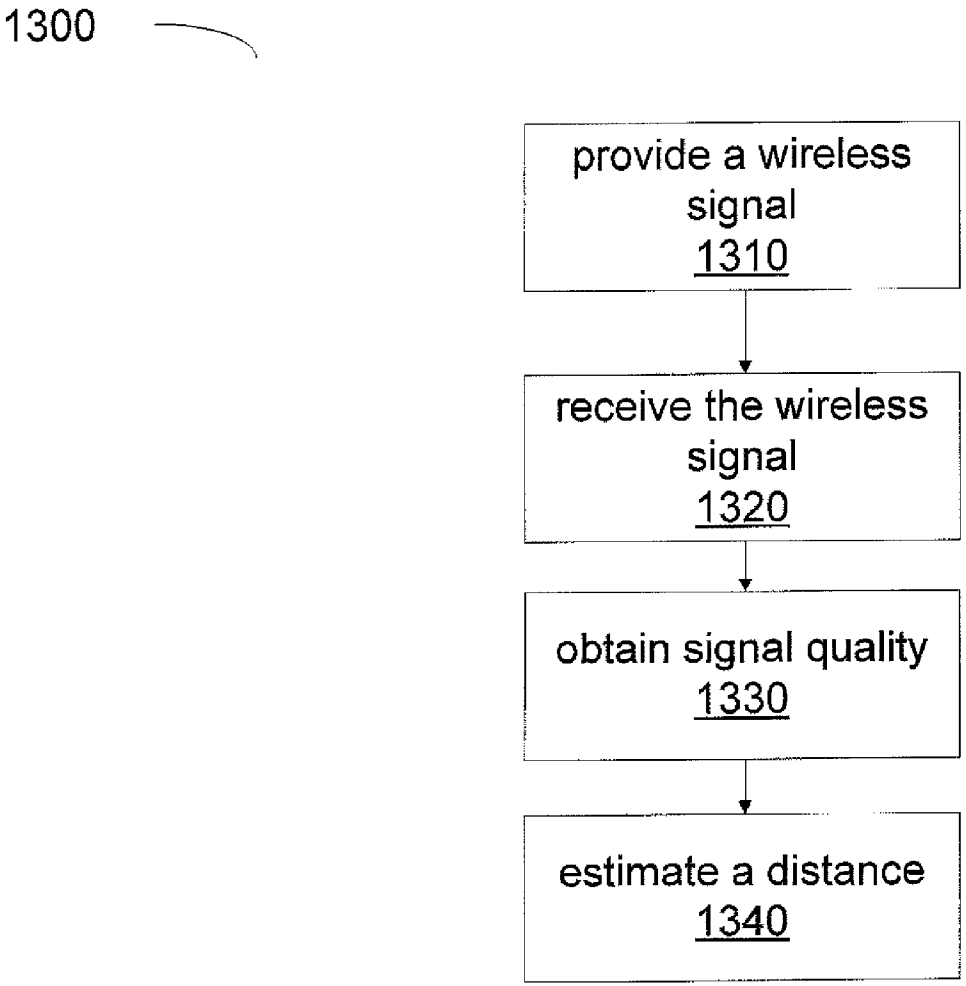
FIG. 13 illustrates a flow chart in a method for estimating a distance using a wireless signal, according to embodiments disclosed herein.

FIG. 13 illustrates a flow chart in a method 1300 for estimating a distance using a wireless signal, according to embodiments disclosed herein. The distance in method 1300 may be the distance separating two communication partners, according to some embodiments. A first communication partner may be a user carrying a wireless appliance with a Radio device including an omni-directional antenna as disclosed herein. The second communication partner may have a wireless appliance with an Radio device providing an RF signal. The user may be moving within reach of the RF signal emitted by a second communication partner. The method may be performed by either one of the first communication partner or the second communication partner. Furthermore, in embodiments of method 1300 some steps may be performed by the first communication partner and some steps may be performed by the second communication partner. Method 1300 may be performed by a system monitoring the two communication partners. The system may be controlled by a computer or by an operator. Either one of the communication partners may be a person carrying a wireless appliance. Either one of the communication partners may be a mobile unit or a fixed unit having attached a wireless appliance. A wireless appliance in each of the communication partners includes at least a receiver device or a transmitter device having an omni-directional antenna according to embodiments disclosed herein.

According to some embodiments, in step 1310 an emitter device provides a calibrated wireless signal output to a receiver device the wireless signal may carry information about the RF output level that was emitted, along with the emitter's antenna gain. In some embodiments of step 1310 the emitter device provides an RF signal having vertical polarization and horizontal polarization. In some embodiments of step 1310 the emitter device provides an RF signal having circular polarization. Further according to some embodiments of step 1310 the emitter device provides a combination of RF signals having vertical polarization, horizontal polarization, and circular polarization.

In step 1320 the wireless signal provided in step 1310 is received by a receiver device in one of the communication partners. Step 1320 may be performed by a user or a mobile unit having a wireless appliance including a receiver device with an omni-directional antenna as disclosed herein. The receiver radio in addition to receiving the signal measures signal quality.

Step 1330 obtains a signal quality of the signal received in step 1320 for both polarization. Step 1330 may be performed by a controller in the wireless appliance including the receiver device (e.g. 163 in FIGS. 2A-2B). Step 1330 may be performed by a controller in the wireless appliance including the emitter device (e.g. 263 in FIGS. 2A-2B). In some embodiments, step 1330 may be performed by a computer in the system controlling the two wireless appliances. According to some embodiments, step 1330 includes performing digital and analogical operations. In some embodiments of step 1330 the digital and analogical operations may include return-signal-strength-indicator (RSSI) algorithms, LQI algorithms, and BER algorithms. In some embodiments, step 1330 includes a combination of one or more of the above algorithms.

In step 1340 a distance separating the two communication partners is estimated using the signal quality measured in step 1330. For example, in some embodiments of step 1340 a signal strength as measured by the receiver device is compared to a function or a table listing signal strength as a function of distance. The table may be stored in a memory circuit, and the function may be computed using a processor circuit. Knowing signal quality, the receiver antenna gain, the transmitter's calibrated output signal level and the transmitter antenna gain, one can use Eq. (1) to estimate Path Loss $L_{FS}$. For a given operating frequency and LoS communication Path loss is a known function of distance, thus distance between transmitter and receiver can be estimated using Eq. (2). The memory circuit and the processor circuit may be included in either one of the wireless appliances including the receiver device or the emitter device. For example, memory circuits 162 and 262, and processors 161 and 261 may be used (cf. FIGS. 2A-2B).

In some embodiments step 1340 is performed sequentially for each one of two orthogonal polarizations included in the RF radiation. For example, step 1340 may be performed when appliance 200A emits vertically polarized RF signals (cf. FIG. 2A). Furthermore, step 1340 may be performed when appliance 200A emits horizontally polarized RF signals (cf. FIG. 2A). Further, in some embodiments a receiver device may include two orthogonally oriented antennas, such as described in FIGS. 9-10. In such embodiments, step 1310, 1320 and 1330 may be performed sequentially for the RF signals detected by each of the two orthogonally oriented antennas. In some embodiments step 1340 is performed at the same time for the two or more orthogonal antennas included in the receiver device.

Figure 14:
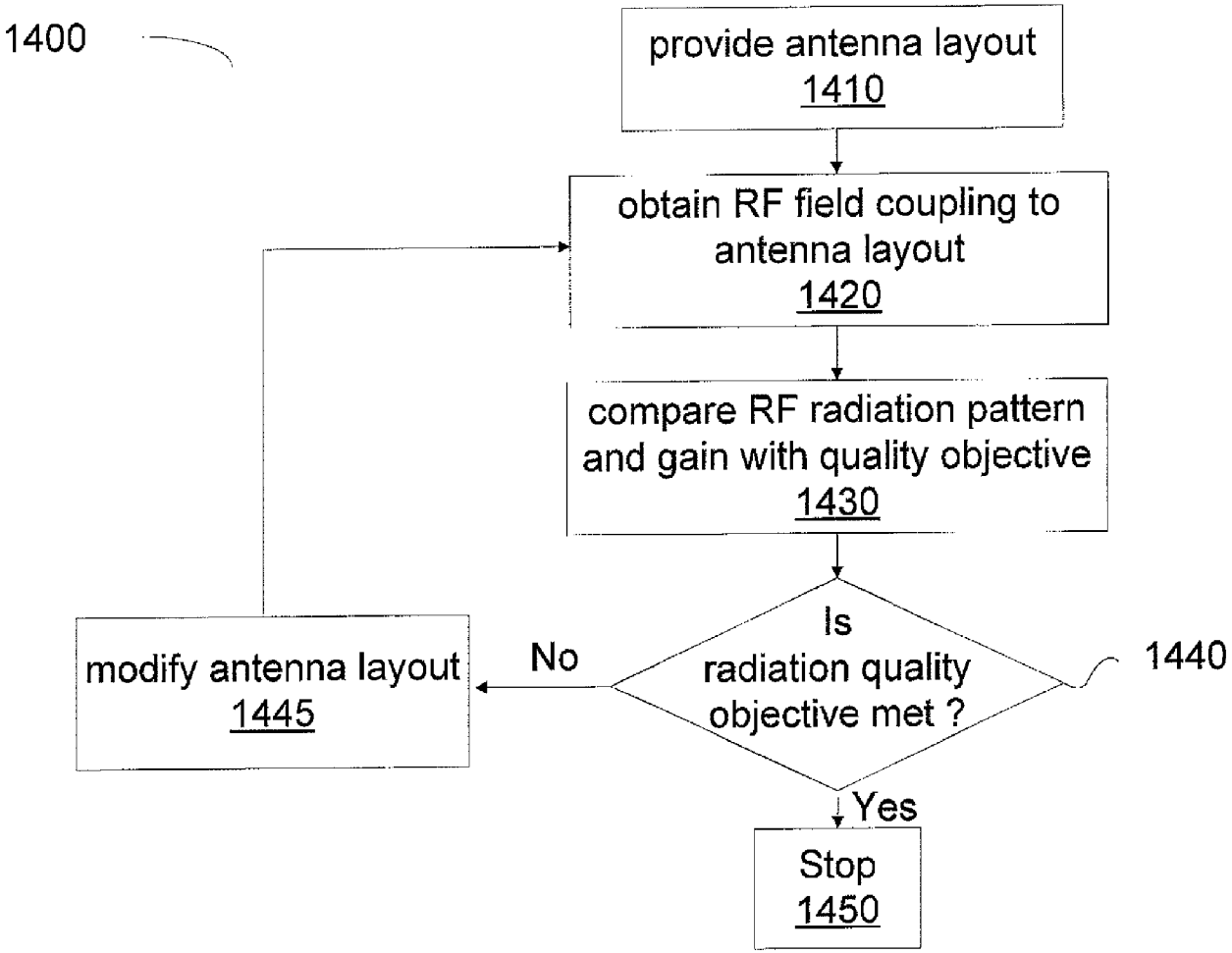
FIG. 14 illustrates a flow chart in a method for providing an antenna in a wireless appliance, according to embodiments disclosed herein.

FIG. 14 illustrates a flow chart for a method 1400 to provide an antenna in a wireless appliance, according to embodiments disclosed herein. Method 1400 may be performed by a machine or a computer. Machines used to perform method 14 may include RF spectrum analyzers, a VNA, oscilloscopes, BER testers, and the like. Method 1400 may also be performed by a prototype assembler. Further embodiments include some steps in method 1400 performed by a machine or a computer, and some steps performed by a prototype assembler. A prototype assembler may be a person or an automatic machine.

In step 1410 an antenna layout is provided. Step 1410 may include providing parameters and diagrams as input to a CAD tool to be performed by a computer. Step 1410 may also include providing a physical prototype of the antenna by a prototype assembler. The parameters provided in step 1410 may be chosen according to a desired radiation pattern.

A desired radiation pattern may include an RF signal having a selected frequency, which determines the wavelength $\lambda 0$ of the RF signal. Having a desired $\lambda 0$, some embodiments of step 1410 find the effective wavelength $\lambda e$ of the desired signal. This may be obtained using a CAD simulation tool or an electromagnetic field solver. In some embodiments of step 1410 the material dielectric constants Dk, the length L, the width W, and the thickness of the antenna are used to find an approximate value of $\lambda e$ corresponding to the desired $\lambda 0$. Having an approximate value for $\lambda e$, further details of the antenna layout may be provided, according to embodiments of method 1400 consistent with the present disclosure.

For example, the radiation field in the X-direction of the antenna structure (cf. FIG. 1) may be selected by choosing design parameters such as the length Ls of slit 110 (Ls, cf. FIG. 1). According to some embodiments of step 1410, Ls may be chosen to be an integer factor of $\frac{1}{4}\lambda e$. In some embodiments step 1410 provides a width for the antenna layout (W, cf. FIG. 1). For example, a width of about $\frac{1}{4}\lambda e$ may be provided. Further embodiments may provide an initial value of W slightly lower than $\frac{1}{4}\lambda e$ by a factor of 0.1 to 0.7. Further embodiments of step 1410 may provide a flare width (Wg, cf. FIG. 1). For example, in some embodiments a value of Wg approximately equal to $\frac{1}{8}\lambda e$ may be provided in step 1410 to realize higher antenna efficiency and near omni-directional radiation response.

In some embodiments of method 1400, it is desired that the resulting antenna has omni-directional response properties, as disclosed herein. To obtain an omni-directional antenna, step 1410 provides parameters such that the radiation field polarized along the 'Y' direction matches the radiation field polarized in the 'X' direction (cf. FIG. 1). In some embodiments step 1410 provides a length for the antenna layout (L, cf. FIG. 1). For example, a value of L may be provided as an integer multiple of $\frac{1}{2}\lambda e$.

Some parameters provided in step 1410 produce desired characteristic impedance for the antenna. In some embodiments it is desired to enhance the coupling efficiency for the freely propagating RF signal into an electric circuit. The optimal efficiency is obtained when the antenna impedance matches the impedance of a coaxial cable or a detector element included in an electric circuit. Thus, step 1410 may provide the location of feed-point point Fp (cf. FIG. 1) chosen to match a desired characteristic impedance.

In step 1420 the RF field coupling to the antenna layout provided in step 1410 is obtained. Some embodiments of step 1420 include simulating RF signals using a CAD tool. A CAD tool may be used to calculate a radiation pattern and antenna gain.

The feed point of the antenna Fp can be iteratively computed by an automation script using a RF Field solver included in a CAD tool. Fp can also be experimentally determined by iterative perturbation and measurement using a CAD tool or a VNA.

Some embodiments of step 1420 include placing an antenna prototype inside a chamber having an RF emitter inside. For example, the chamber may be an anechoic chamber. The antenna prototype may be coupled to a VNA tool while inside the chamber. A VNA tool is used to measure prototype antenna's radiation pattern and gain.

In some applications the antenna surface has a dielectric material around it (e.g. PCB or other supporting structure), the capacitive effect of the dielectric can be computed using field solving techniques. The capacitive effect of the dielectric can also be experimentally determined by iterative perturbation and measurement.

The fringe effects of the edge of the metallic surface can be computed using field solver computing techniques to optimize the dimensions of the antenna. Fringe effects can also be determined by iterative perturbation and measurement using CAD tools and a VNA.

In step 1430 the RF field coupling is compared to a quality standard. In some embodiments step 1430 includes measuring a signal quality using digital and analogical operations from the electrical signal. Signal quality may include RSSI data, LQI data, or BER data. In some embodiments step 1430 may include measuring a spectral response of the omni-directional antenna and comparing it to a quality standard. The quality standard may include parameters such as center frequency, 3 dB bandwidth, and maximum amplitude.

Step 1440 includes determining whether or not the antenna satisfies the quality standard used for comparison in step 1430. If it does, method 400 is stopped in step 1450.

If the antenna fails to satisfy the quality standards in step 1430, step 1445 includes modifying the antenna layout. In some embodiments, step 1445 includes tuning the antenna by adjusting layout parameters. Some of the layout parameters that may be adjusted are the length of one or both lips (e.g. L301 and L302 in FIG. 3). The antenna can be tuned by the addition or removal of dielectric material between the two lips (e.g. 101 and 102 in FIG. 1).

In some embodiments, step 1445 includes fine tuning the antenna resonance frequency by cutting a slot in the dielectric material in the slit separating the two conducting lip (e.g. 110 in FIG. 1). This increases the resonance frequency. In some embodiments step 1445 includes fine tuning the antenna resonance frequency by adding a high Dk material in the slit separating the two conducting lips. This reduces the resonance frequency. In some embodiments step 1445 includes fine tuning the antenna resonance frequency by adding a high Dk material on the extremities of the two conducting lips. This reduces the resonance frequency.

After modifying the antenna layout in step 1445, method 1400 is repeated from step 1420, until the antenna satisfies the radiation quality standard in step 1430.

Embodiments of method 1400 may be used to design a first prototype of an antenna. The first prototype is fed into a RF CAD system to iteratively adjust the antenna design for desired radiation, electronic and mechanical characteristics. The prototype is verified experimentally and if necessary iterative perturbation and measured till optimum behavior is realized.

Embodiments of devices and methods as disclosed above allow making a compact appliance where both the antenna and circuitry are provided in the same package (e.g. a PCB package). In some embodiments a method for providing a wireless appliance on a PCB integrated circuit having an omni-directional antenna is disclosed. According to such embodiments, the wireless appliance may have a reduced physical size shorter than ½λe in length and ¼λe in width.

Embodiments consistent with the present disclosure may be utilized in applications including Radio communication antennas, RFID devices and systems, RF heating, RF stealth, Radar Cross Section (RCS) uniformity, RF absorbing/anechoic application, Passive antenna in a larger antenna array, RF direction finding, Proximity sensing, Flight termination systems in rockets and missiles, Telemetry, and tracking and control systems for flight vehicles or munitions.

Embodiments described above are exemplary only. One skilled in the art may recognize various alternative embodiments from those specifically disclosed. Those alternative embodiments are also intended to be within the scope of this disclosure. As such, the invention is limited only by the following claims.

What is claimed is:

1. An antenna for use in a wireless appliance, comprising:

a conducting surface having a length and a width, wherein the length is greater than the width and the width is less than a quarter of a first wavelength which is an operating wavelength of the antenna;

a dielectric slit having a slit length portion oriented along the length, the slit forming two lips on the conducting surface;

the slit length portion extending along the length to provide mouth that opens out of the conducting surface;

a feed-point element connecting the two lips.

2. The antenna as in claim 1 wherein the two lips form respectively a first side and a second side of the slit, each side having a shape;

wherein the first side and the second side have different lengths and different shapes.

3. The antenna as in claim 1 wherein the two lips form respectively a first side and a second side of the slit, each side having a shape;

wherein each side has either an exponential function shape or a shape formed of linear segments.

4. The antenna as in claim 1 wherein the two lips form respectively a first side and a second side of the slit, each side having a shape;

wherein each side has a tangent function shape.

5. The antenna as in claim 1 wherein the slit forms a tip at a junction point of the two lips;

wherein the tip is bent in the plane of the conducting surface.

6. The antenna as in claim 1 wherein the dielectric slit is formed of a dielectric material having a dielectric constant greater than 3, at the first wavelength.

7. The antenna as in claim 1 wherein the length is approximately equal to one half of the effective wavelength and the width is approximately equal to one quarter of the effective propagation wavelength.

8. The antenna as in claim 1 wherein the length is approximately equal to an integer multiple of one half of the effective wavelength and the width is approximately equal to one quarter of the effective propagation wavelength.

9. A method for estimating a distance between a first wireless appliance and a second wireless appliance, the method comprising the second wireless appliance performing operations of:

receiving a wireless signal from the first wireless appliance by a receiver device of the second wireless appliance, the receiver device comprising the antenna of claim 1, wherein the wireless signal is received at the antenna;

obtaining a signal quality of the received wireless signal;

estimating a distance separating the first wireless appliance from the second wireless appliance, the distance being estimated from the received wireless signal.

10. The antenna of claim 1 wherein for at least one antenna position relative to a source of two linearly polarized electromagnetic waves one of which is polarized along a first polarization axis and the other one of which is polarized along a second polarization axis perpendicular to the first polarization axis, and for at least one predefined axis passing through the antenna and parallel to the first polarization axis, a condition holds that a sum of the antenna's response to the two linearly polarized electromagnetic waves varies by no more than a first value not exceeding 15 dB as the antenna is rotated around the first predefined axis.

11. The antenna of claim 10 wherein the first value does not exceed 10 dB.

12. The antenna of claim 10 wherein said condition holds for at least one of positional relationships (A), (B), and (C):

(A) the first predefined axis extends along the length;

(B) the first predefined axis extends along the width;

(C) the first predefined axis is perpendicular to the length and the width.

13. The antenna of claim 12 wherein the first value does not exceed 10 dB.

14. The antenna of 12 wherein the said condition holds for each of (A), (B) and (C).

15. The antenna of claim 14 wherein the first value does not exceed 10 dB.

16. A method for estimating a distance between a first wireless appliance and a second wireless appliance, the method comprising:

the second wireless appliance receiving a first wireless signal from the first wireless appliance by a receiver device of the second wireless appliance, the receiver device comprising the antenna of claim 10, wherein the first wireless signal is received at the antenna and is polarized along the first polarization axis;

the second wireless appliance obtaining a signal quality of the received first wireless signal;

the second wireless appliance receiving a second wireless signal from the first wireless appliance by the receiver device of the second wireless appliance, wherein the second wireless signal is received at the antenna and is polarized along the second polarization axis;

the second wireless appliance obtaining a signal quality of the received second wireless signal; and the second wireless appliance estimating the distance between the first and second wireless appliances based on the signal qualities of the received first and second wireless signals, and/or sending information on the signal qualities to the first wireless appliance to enable the first wireless appliance to estimate the distance between the first and second wireless appliances based on the signal qualities.

17. The method of claim 16 wherein estimating the distance is based on a Free Space Loss parameter.

18. The method of claim 16 wherein the second wireless appliance estimates the distance.

19. The method of claim 16 wherein the second wireless appliance sends said information to the first wireless appliance, the method further comprising estimating said distance by the first wireless appliance.

20. The antenna of claim 1 wherein the slit length portion is tapered to flare out towards the mouth.

21. The antenna of claim 20 wherein the slit's flare width is no greater than one eighth of the first wavelength.

22. An antenna structure for use in a wireless appliance, comprising:

a first antenna for providing a gain with respect to electromagnetic ("EM") radiation polarized in an XY plane of a Cartesian XYZ frame; and a second antenna for providing a gain with respect to EM radiation polarized along the Z axis of the Cartesian XYZ frame;

wherein the first and second antennas share a conductive surface extending in the XY plane, wherein the conductive surface is for providing coupling to EM radiation polarized in the XY plane;

wherein the second antenna comprises a conductive plate spaced from the conductive surface along the Z axis, the conductive plate having a contact portion connected to the conductive surface;

wherein:

in a projection onto the XY plane along the Z axis, the conductive plate lies entirely within the conductive surface;

the second antenna structure comprises a gap between the conductive surface and the conductive plate, the gap having a width along the Z axis to provide a gain with respect to EM radiation polarized along the Z axis in the gap;

the second antenna is operable to provide coupling to EM radiation polarized along the Z axis in the gap;

the antenna structure comprises one or more feed-point elements connected to the conductive plate and to the conductive surface.

23. The antenna structure of claim 22, wherein the first antenna comprises a dielectric slit forming two lips on the conductive surface and extending to provide a mouth that opens out of the conductive surface;

wherein the one or more feed-point elements comprise a first feed-point element connecting the two lips.

24. The antenna structure of claim 22 wherein the first and second antennas provide antenna diversity.

* * * * *